US011519152B2

(12) United States Patent
Lancaster et al.

(10) Patent No.: US 11,519,152 B2
(45) Date of Patent: Dec. 6, 2022

(54) SYSTEM AND METHOD FOR INSTALLING A MEMBRANE-LINED BURIED WALL

(71) Applicant: Levee Lock, LLC, Fargo, ND (US)

(72) Inventors: James H. Lancaster, Fargo, ND (US); Gerald L. Deneal, Harrisburg, IL (US); Eric E. Gregg, Harrisburg, IL (US)

(73) Assignee: Levee Lock, LLC, Fargo, ND (US)

( * ) Notice: Subject to any disclaimer, the term of this patent is extended or adjusted under 35 U.S.C. 154(b) by 0 days.

(21) Appl. No.: 17/221,074

(22) Filed: Apr. 2, 2021

(65) Prior Publication Data

US 2021/0222390 A1 Jul. 22, 2021

Related U.S. Application Data

(63) Continuation-in-part of application No. 17/000,984, filed on Aug. 24, 2020, now Pat. No. 11,230,818, which is a continuation of application No. 16/537,928, filed on Aug. 12, 2019, now Pat. No. 10,753,061, which is a continuation-in-part of application No. 16/220,139, filed on Dec. 14, 2018, now Pat. No. 10,501,908.

(51) Int. Cl.

| | |
|---|---|
| ***E02D 31/00*** | (2006.01) |
| ***E02D 29/02*** | (2006.01) |
| ***E02F 5/02*** | (2006.01) |
| ***E02D 17/20*** | (2006.01) |
| ***E02D 19/22*** | (2006.01) |

(52) U.S. Cl.

CPC ..... *E02D 29/0275* (2013.01); *E02D 17/20* (2013.01); *E02D 17/202* (2013.01); *E02D 19/22* (2013.01); *E02F 5/02* (2013.01); *E02F 5/025* (2013.01); *E02D 2250/0023* (2013.01); *E02D 2300/002* (2013.01); *E02D 2600/10* (2013.01)

(58) Field of Classification Search

CPC ..... E02D 19/18; E02D 29/0275; E02B 3/102; E02B 3/10

See application file for complete search history.

(56) References Cited

U.S. PATENT DOCUMENTS

| | | | |
|---|---|---|---|
| 3,197,964 | A | 8/1965 | Fehlmann |
| 3,854,292 | A | 12/1974 | Nienstadt |
| 3,990,200 | A | 11/1976 | Kawasaki |
| 4,453,861 | A | 6/1984 | Bretz |
| 4,666,334 | A | 5/1987 | Karaus |
| 4,728,226 | A | 3/1988 | Ressi de Cervia |

(Continued)

OTHER PUBLICATIONS

U.S. Non-Final Rejection Issued from USPTO for U.S. Published Application US2020/0277749 A1; Dec. 24, 2020.

*Primary Examiner* — Carib A Oquendo
(74) *Attorney, Agent, or Firm* — Neustel Law Offices

(57) ABSTRACT

A system and method for installing a membrane-lined wall for levee reinforcement or leak prevention. The installation system may comprise a sled positioned above the trench having a length, and may comprise a frame and support members, and a weight suspension system mounted on the frame to lower an elongated weight into the trench. The liner installation sled may also include a liner roller rotatably mounted on the frame, the liner roller adapted to hold a roll of a liner above the surface on a first side of the trench when the liner installation sled is in an installation position relative to the trench, wherein a longitudinal axis of the roll of liner can be aligned with the length of the trench. The elongated weight is usable to force the liner into the trench.

20 Claims, 26 Drawing Sheets

(56) References Cited

U.S. PATENT DOCUMENTS

| | | | |
|---|---|---|---|
| 4,828,432 | A | 5/1989 | Ives |
| 4,927,297 | A | 5/1990 | Simpson |
| 4,929,126 | A | 5/1990 | Steenbergen |
| 4,934,865 | A | 6/1990 | Varkonyi |
| 4,955,759 | A | 9/1990 | Payne |
| 5,158,398 | A | 10/1992 | Pinho |
| 5,246,312 | A | 9/1993 | Taki |
| 5,454,668 | A | 10/1995 | Liao |
| 5,720,580 | A | 2/1998 | Ryhsen |
| 5,735,638 | A | 4/1998 | Beamer |
| 6,224,296 | B1 | 5/2001 | Fukumori |
| 6,443,666 | B1 | 9/2002 | Smith |
| 6,562,177 | B1 | 5/2003 | Payne |
| 6,786,446 | B1 | 9/2004 | Kaul |
| 7,373,892 | B2 | 5/2008 | Veazey |
| 8,387,334 | B2 | 3/2013 | Gulati |
| 8,613,573 | B2 | 12/2013 | Kadiu |
| 8,898,996 | B2 | 12/2014 | Garzon |
| 2008/0179253 | A1 | 7/2008 | Clark |
| 2009/0252555 | A1 | 10/2009 | Hartenburg |
| 2010/0215441 | A1 | 8/2010 | Saadatmanesh |
| 2017/0254037 | A1 | 9/2017 | Ragsdale, Jr. |

SYSTEM AND METHOD FOR INSTALLING A MEMBRANE-LINED BURIED WALL

CROSS REFERENCE TO RELATED APPLICATIONS

The present application is a continuation-in-part of U.S. application Ser. No. 17/000,984 filed on Aug. 24, 2020, which is a continuation of U.S. application Ser. No. 16/537,928 filed on Aug. 12, 2019 now issued as U.S. Pat. No. 10,753,061, which claims priority to U.S. application Ser. No. 16/220,139 filed Dec. 14, 2018 now issued as U.S. Pat. No. 10,501,908. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a system and method for installing a membrane-lined wall.

Related Art

Any discussion of the related art throughout the specification should in no way be considered as an admission that such related art is widely known or forms part of common general knowledge in the field.

Levees have been in use for many years, and levee repair systems and methods for just about as long. Cutoff walls are one way to reinforce and prevent leakage in levees, but permeability of materials used (such as concrete) and soil contamination of the concrete during the curing process can reduce the integrity and strength of the cutoff wall. Further, without reinforcement, cutoff walls may be susceptible to seismic and other forces.

SUMMARY

An example embodiment is directed to a system and method for installing a membrane-lined wall. The membrane-lined wall is formed in-place in a trench, typically a narrow, deep trench, formed by excavating the trench, typically along the top of a levee, although the wall system and the method for constructing it is particularly suitable for forming membrane-lined walls on the slope of a levee, as needed for localized problem areas.

In addition to levee reinforcement, the membrane-lined wall is also useful for stopping or preventing levees from leaking, for preventing pollution due to the migration of water or liquid contaminants, such as around the perimeter of waste disposal sites, coal slurry impoundments, and any other sites where groundwater movement should be stopped to prevent water contamination.

The membrane-lined wall comprises cementitious material, such as concrete, that fills the trench. The membrane-lined wall is formed by excavating a trench in the earth, the trench having two sides, a bottom, and a length. Next, a liner, which may be a low-permeability geomembrane, is installed in the trench along the length of the trench, the liner forming a continuous barrier between the two sides and the bottom of the trench and an interior portion of the liner in at least one dimension. After the liner is installed, a reinforcement mat is also installed within the interior portion of the liner, the reinforcement mat having a length aligned with the length of the trench, and having a height aligned with the two sides of the trench. As an example, the reinforcement mat may be a galvanized steel mesh, such as grade 40 galvanized wire mesh with rectangular openings. Other types of reinforcement, or reinforcement in addition to the mesh, may also be used.

The next step comprises filling at least part of the interior portion of the liner with a cementitious material that surrounds the reinforcement mat within the interior portion of the liner, wherein the weight of the cementitious material forces the liner into close contact with the sides of the trench, and then allowing the cementitious material to harden. The cementitious material, or concrete, can surround the reinforcement mat on three sides (such as both vertical sides and the bottom), or on all sides.

To add structural integrity, the reinforcement mat may come in sections, which are then joined together once they are in place in the trench to form a substantially continuous structure. In such an embodiment, the mat sections are joined together at a vertical edge between sections, so that the resulting reinforcement is aligned linearly along the length of the trench. For deeper trenches, multiple vertical sections of reinforcement mat may be required, and in such case, the sections may also be joined along the horizontal edges between them. The sides of the trench may be vertical in some example embodiments.

In an example embodiment, vibration, such as by an internal vibrator, may be applied to the cementitious material before it hardens. The vibration during the hardening process can remove air in the cementitious material and prevent honeycombing, which can weaken the wall.

In an example embodiment, the geomembrane liner comprises two layers of the low-permeability membrane, an inner layer adjacent to the interior portion of the liner, and an outer layer adjacent to the sides and the bottom of the trench. The inner layer of the liner may comprise multiple sections, wherein each section forms an overlap with an adjacent section along a first edge. Such multiple sections may also have an adhesive layer or coating applied at their edges between each adjacent section of the inner layer of the liner.

Further, the outer layer of the liner may comprise multiple sections, wherein each section of the outer layer forms an overlap with an adjacent section of the outer layer along a second edge. In such an embodiment, each overlap of the inner layer may be spaced apart from each overlap of the outer layer in a direction along the length of the trench.

In an example embodiment, forming the membrane-lined wall may further comprise positioning a roll of liner material over one side of the trench, positioning and clamping a lengthwise edge of the liner material over a side of the trench opposite the roll of liner material, and lowering a weight into the trench along the length of the trench to cause the liner material to unroll from the roll of liner material and extend into the trench. In using this method, the liner may then be cut from the roll, lengthwise, so that both edges of the liner (either one or two layers) are at the top of the trench, with a "pocket" of the liner extending down into the trench.

In addition to the preceding method of installing a liner, an example embodiment may further comprise positioning a second roll of second liner material over one side of the trench, and positioning and clamping a lengthwise edge of the second liner material over a side of the trench opposite the second roll of second liner material, and lowering a lengthwise weight into the trench to cause the liner material and the second liner material to unroll and extend into the trench. As with previous embodiments, the cementitious material may comprise concrete.

In another example embodiment, the liner of the membrane-lined wall comprises two layers of a low-permeability membrane, an inner layer adjacent to the interior portion of the liner, and an outer layer adjacent to the sides and the bottom of the trench.

Other example embodiments include a method of excavating the trench that provides for forcing the sides of the trench away from the interior portion of the trench, which can compress the soil of the sides and reduce the tendency of the sides to collapse. The method includes excavating a first depth of the trench extending from a surface of the ground to a first distance; applying an outward force from the interior portion against the two sides along the first depth of the trench; and excavating a second depth of the trench below the first depth such that the two sides extend to a second distance.

The method may further comprise maintaining the outward force against the two sides while excavating the second depth. For example, the second depth may be excavated using an excavator having a boom that extends under an apparatus (such as an air-lift cushion or plates with hydraulic rams between them) that applies the outward force from a position beyond the apparatus along the length of the trench. The excavation method may further comprise applying a force against the two sides along the second depth—that is, below the first depth of the trench.

Once the trench has been excavated, using any method, the membrane-lined wall may be formed as described herein. In addition, a moisture detector can be inserted in the wall, such as in the interior portion, so that if moisture penetrates the membrane, a signal can be produced and sent alerting users to that fact. For example, the moisture detector can be placed proximate the bottom of the trench, inside the liner, and as a further example, it may be a wired sensor that is placed prior to applying cementitious material to the trench. Of course, more than one sensor can be used, and for efficient processing, sensors can be embedded in the reinforcing material or in the liner itself. Once placed, the moisture sensors may be electrically connected to a control unit, which may be actively monitored or which may send radio or cellular signals indicating the presence of moisture detected by the sensor.

In an example embodiment, the liner membrane may be installed quickly and efficiently with a liner installation sled. The liner installation sled may be adapted for being positioned above a trench having a length, and the liner installation sled may comprise a frame and at least two support members mounted on the frame, the at least two support members adapted to movably support the frame on a surface over the trench. The liner installation sled may also include a liner roller rotatably mounted on the frame, the liner roller adapted to hold a roll of a liner above the surface on a first side of the trench when the liner installation sled is in an installation position relative to the trench, wherein a longitudinal axis of the roll of liner can be aligned with the length of the trench.

The liner installation sled includes a weight suspension system mounted on the frame and adapted to movably suspend an elongated weight that can be lowered into the trench and raised out of the trench, and the liner installation sled also may have an elongated liner edge holder mounted on the frame to hold an edge of the liner above the trench, wherein the liner end clamp is mounted so that it is alignable with the length of the trench, wherein the elongated weight is usable with the weight suspension system to force a portion of the liner between the liner end clamp and the liner roll into the trench as described above and herein. The liner end clamp may be or comprise a cylindrical shaft, adapted to clamp and hold a free edge of liner material above the surface on a second side of the trench when the liner installation sled is positioned in the installation position relative to the trench.

In some example embodiments, the liner installation sled further comprises a positioning roller mounted on the frame and positionable above the trench such that a portion of the liner will move from the liner roll and over the positioning roller when the elongated weight is lowered into the trench. The positioning roller can be rotatably mounted on the frame such that it can rotate due to the liner moving over the positioning roller. In addition, the elongated weight can be rotatably suspended from the weight suspension system such that the elongated weight can rotate when the elongated weight is lowered due to the liner moving around the elongated weight.

The weight suspension system may comprise two reels, one at each end of the frame, wherein each reel is adapted to raise and lower a cable attached to an end of the elongated weight. Each cable may be rotatably attached to the elongated weight, for example with a bearing or bushing, such that the elongated weight can rotate when the elongated weight is lowered due to the liner moving relative to the elongated weight.

In some example embodiments, the at least two support members are adjustably mounted on the frame such that the frame can be supported on the surface when the surface is sloped, wherein the frame is alignable by adjustment of at least one of the at least two support members such that a centerline of the frame is above the trench when the liner installation sled is positioned in the installation position relative to the trench. The at least two support members may comprise skids to allow movement of the liner installation sled on the surface over the trench. The may also comprise wheels or tracks for use with different surface types.

The liner installation sled may be used for lining a trench that has two sides and a bottom. The method may include positioning the liner installation sled in the installation position relative to the trench such that the longitudinal axis of the liner roller is aligned with the length of the trench above the surface on the first side of the trench, wherein the edge of the liner is held in position and aligned with the length of the trench by the liner end clamp, above the trench. The method further includes forcing a portion of the liner between the edge and the roll into the trench using the elongated weight such that the liner is supplied from the roll and extends into the trench to form a continuous, seamless barrier between the two sides and the bottom of the trench and an interior portion of the liner.

Example embodiments of the liner installation sled may further comprise a second liner roller rotatably mounted on the frame, the second liner roller adapted to hold a second roll of liner above the surface on the first side of the trench, wherein a longitudinal axis of the second roll of liner is aligned with the longitudinal axis of the liner roller, wherein the liner end clamp also holds a second edge of the second liner above the trench. In this embodiment, the elongated weight is also usable to force a portion of the second liner into the trench.

There has thus been outlined, rather broadly, some of the embodiments of the membrane-lined wall in order that the detailed description thereof may be better understood, and in order that the present contribution to the art may be better appreciated. There are additional embodiments of the membrane-lined wall that will be described hereinafter and that will form the subject matter of the claims appended hereto. In this respect, before explaining at least one embodiment of the system and method for installing a membrane-lined wall in detail, it is to be understood that the system and method for installing a membrane-lined wall is not limited in its application to the details of construction or to the arrangements of the components set forth in the following description or illustrated in the drawings. The system and method for installing a membrane-lined wall is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
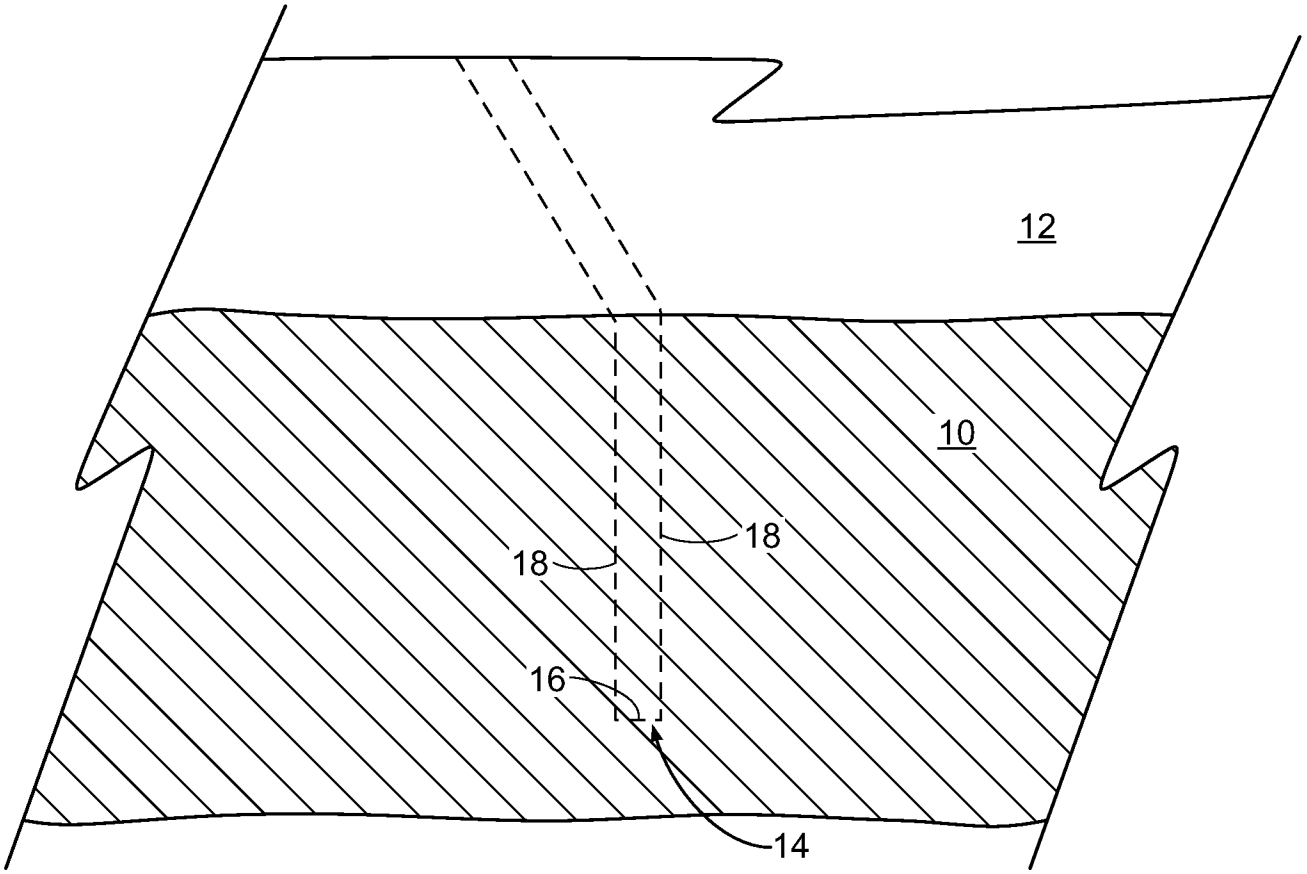
FIG. 1 is a perspective view of a site where a membrane-lined wall is to be installed in accordance with an example embodiment.
Figure 2:
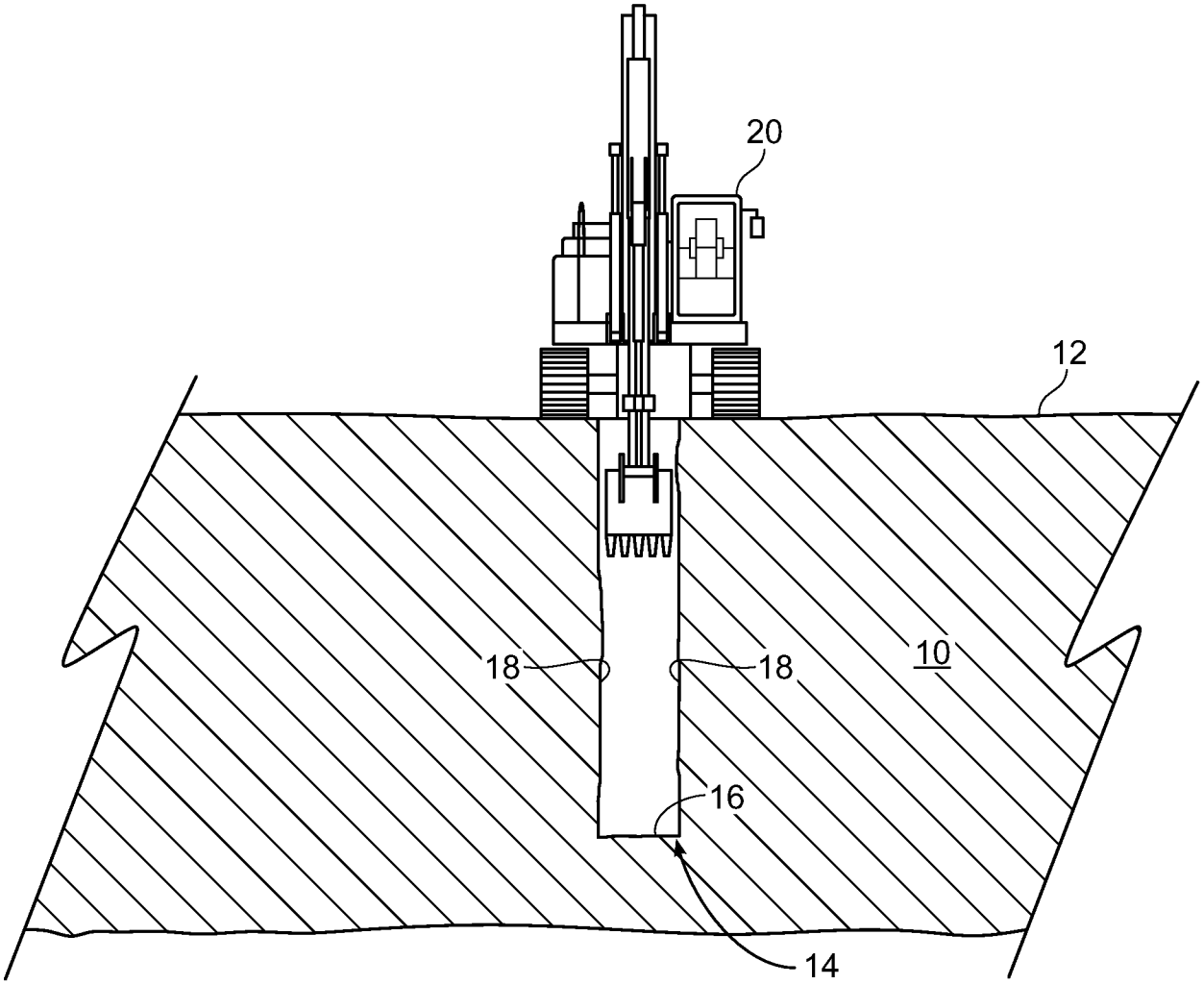
FIG. 2 is a sectional view of a site being excavated where a membrane-lined wall is to be installed in accordance with an example embodiment.

A. Overview.

An example membrane-lined wall generally comprises a reinforced, protected concrete wall 80 that is formed in place in a trench excavated in the desired location in the earth 10, such as the berm of a levee or the perimeter of a waste disposal site, as just two examples. The wall 80 can be formed anywhere it is needed, such as at the top, generally level portion of a levee berm, or it can be formed on a sloped portion of the berm, to strengthen, reinforce, or prevent leakage in a levee or other site in localized areas, as needed. Further, the methods described herein can be used anywhere a reinforced, waterproof in-ground wall is needed—not just for levees.

To form the wall 80 where it is needed, a location for trench 14 is first determined. This determination will include the location on the levee, waste disposal site, etc., as well as the needed depth and width. The trench, once formed, will comprise sidewalls 18 and bottom 16, and may be substantially rectangular, with a bottom 16 being horizontal or substantially horizontal, and the sidewalls 18 being vertical, or substantially vertical.

Wall 80 may generally comprise cementitious material 82, such as concrete. The wall 80 may also include a reinforcing mat or layer 84, which may be substantially parallel to the sides 18 of the trench 14. The reinforcing mat 84 may be, for example, made of galvanized steel. Further, multiple sections or pieces of reinforcing mat 84 may be installed in the trench 14 and held within the concrete or cementitious material 82, especially where the depth or length of the trench requires. For example, if the trench 14 is too deep or too long for a single piece of reinforcing material, multiple sections or pieces of reinforcing mat 84 will be needed. Such multiple sections may be joined together for added strength, either in multiple horizontal sections, multiple vertical sections (one section atop another), or both horizontal and vertical sections.

The wall 80 may be protected by, for example, one or two layers of a low-permeability liner 62, such as HDPE geomembrane. Such liners are anti-aging, UV resistant, and are impermeable. Accordingly, by installing liners 62 in a trench before concrete or other cementitious material 82 is added, the liners will not only make the wall 80 substantially impermeable (which will make it last longer and be a more effective barrier against erosion, etc.), but the liner 62 will prevent soil, and any substances in the soil, from contaminating the concrete or cementitious material during curing. This will result in a better concrete wall 80.

The liners 62 may be efficiently installed by using a liner installation sled 40.

B. Trench Excavation.

Figure 3:
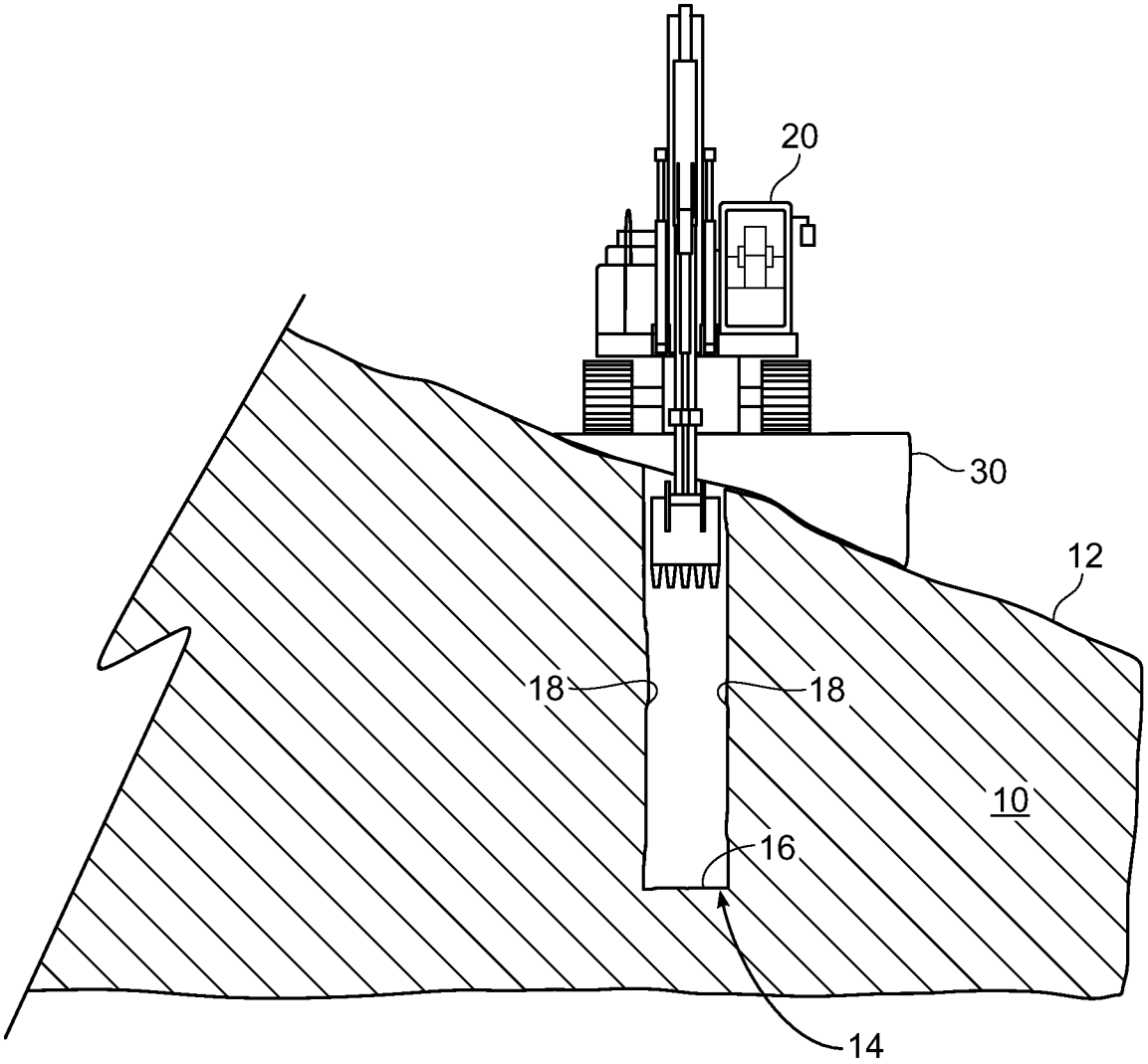
FIG. 3 is another sectional view of a site being excavated where a membrane-lined wall is to be installed in accordance with an example embodiment.
Figure 4:
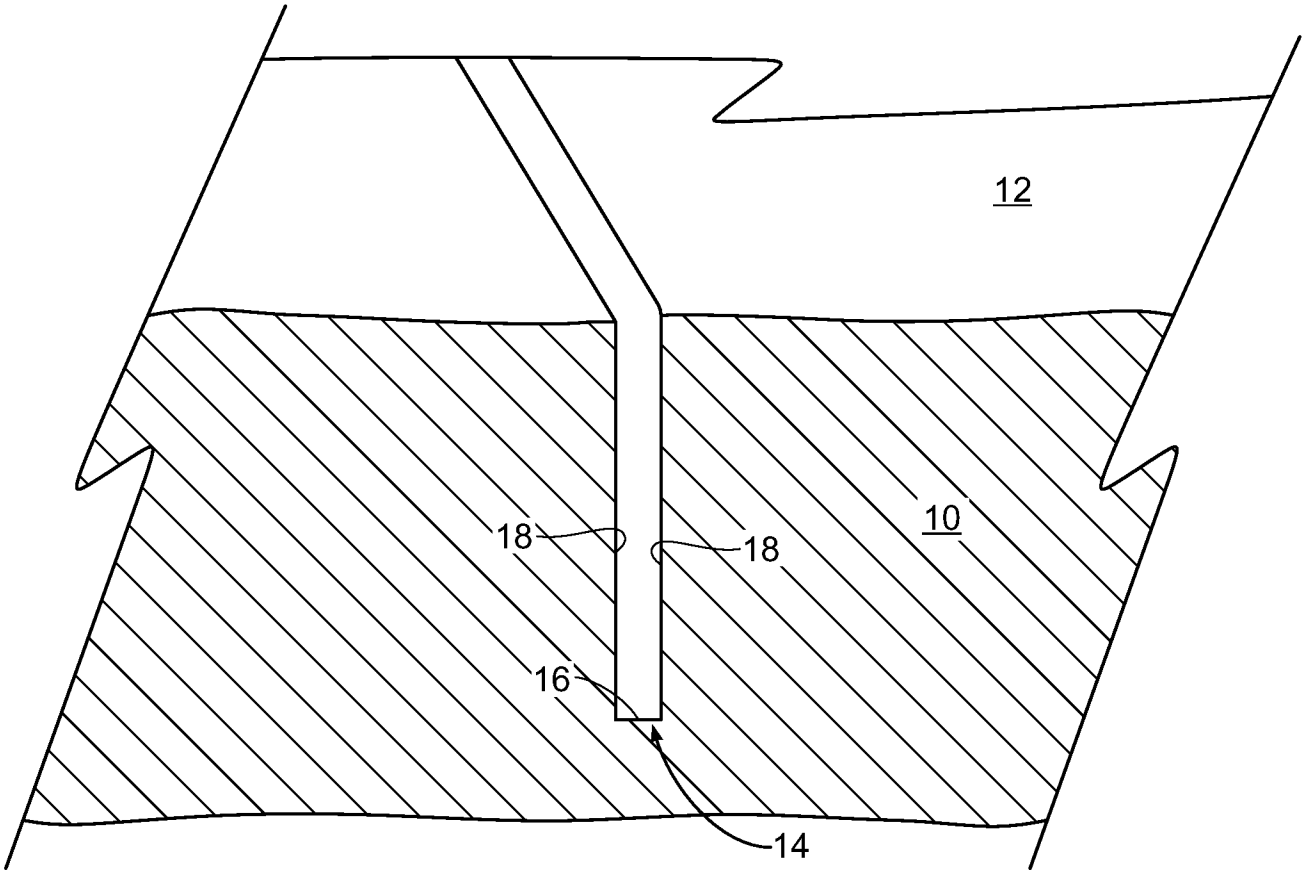
FIG. 4 is a perspective, sectional view of an excavated site where a membrane-lined wall is to be installed in accordance with an example embodiment.
Figure 5:
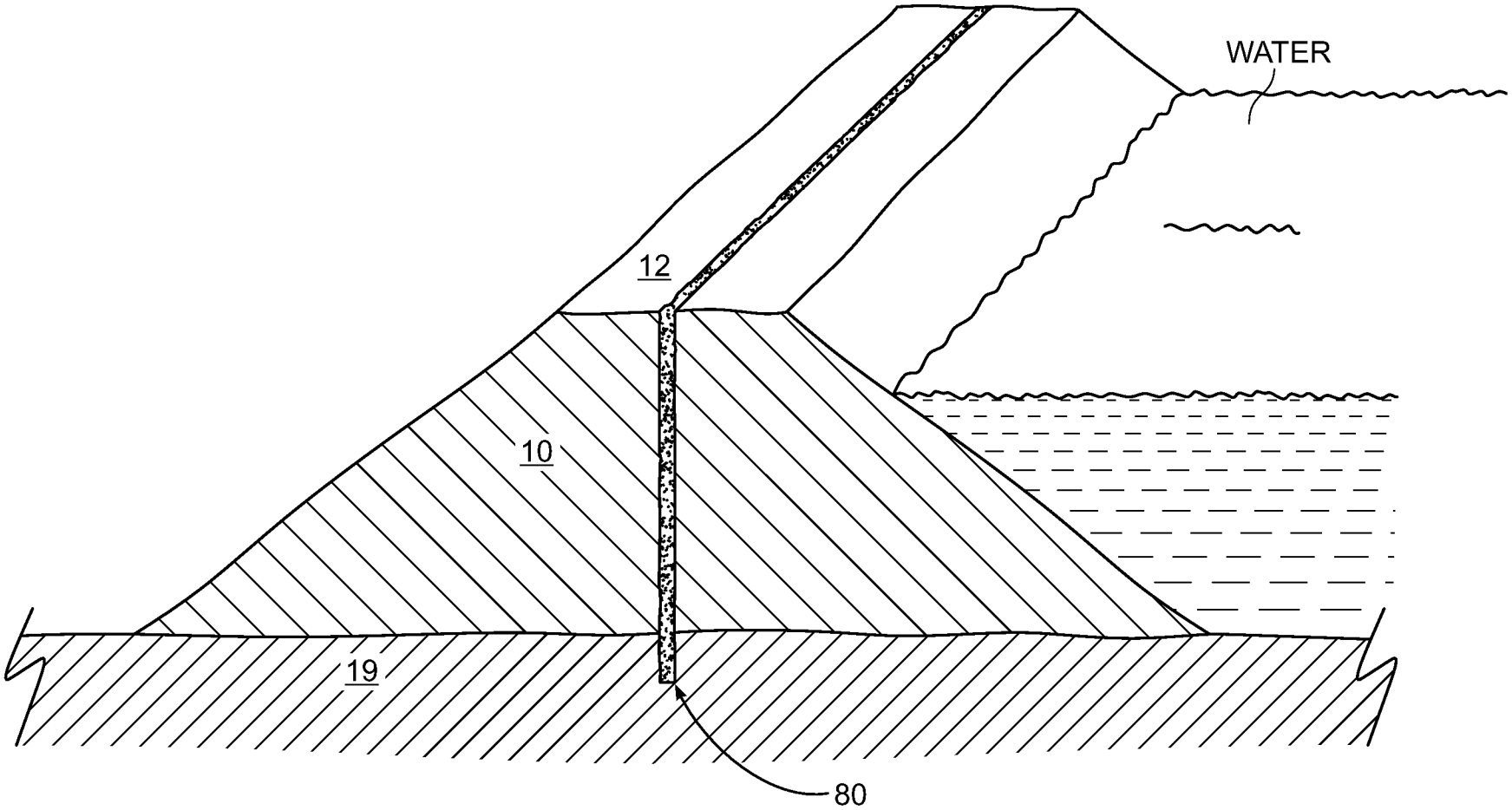
FIG. 5 is a perspective, sectional view of a membrane-lined wall installed in accordance with an example embodiment.
Figure 6:
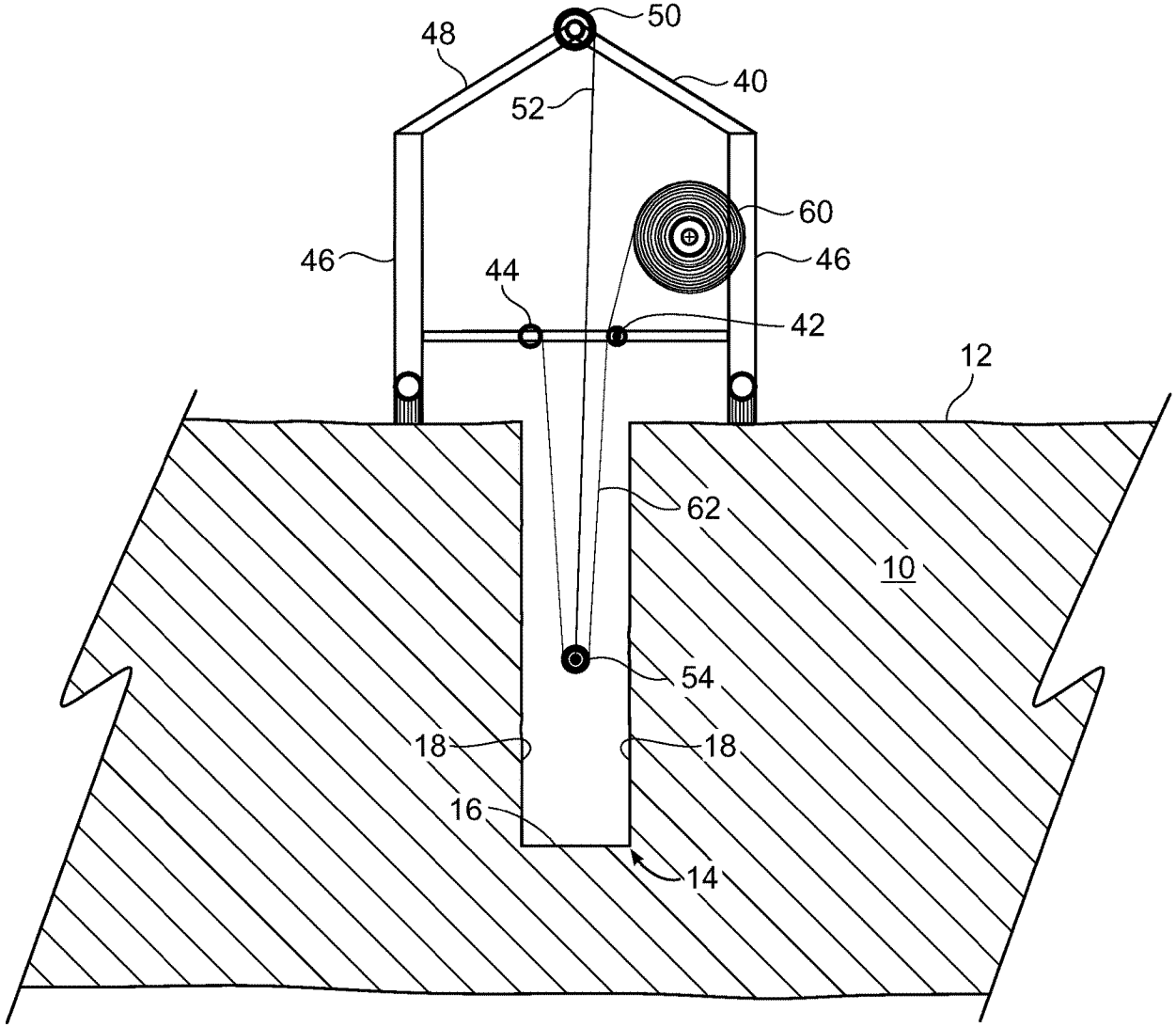
FIG. 6 is a sectional view of a liner being installed in an excavated trench where a membrane-lined wall is to be installed in accordance with an example embodiment.

As shown in FIG. 1, the first step in forming the reinforced membrane-lined wall requires that a determination be made regarding location. Typically, the membrane-lined wall 80 will be formed along the top of a levee wall, as best shown in FIG. 5, although the wall can also be formed on the slope of a levee's berm, as shown in FIG. 3. Further, as stated previously, the membrane-lined wall can be used in other applications and locations, such as for containment ponds, slurry impoundments, etc. Once the desired location is determined, the trench 14 may be excavated from the surface 12 of earth 10 using an excavator 20, which may be a long-boom excavator, for example. For deeper trenches, other machines and techniques may be used as well.

Figure 14:
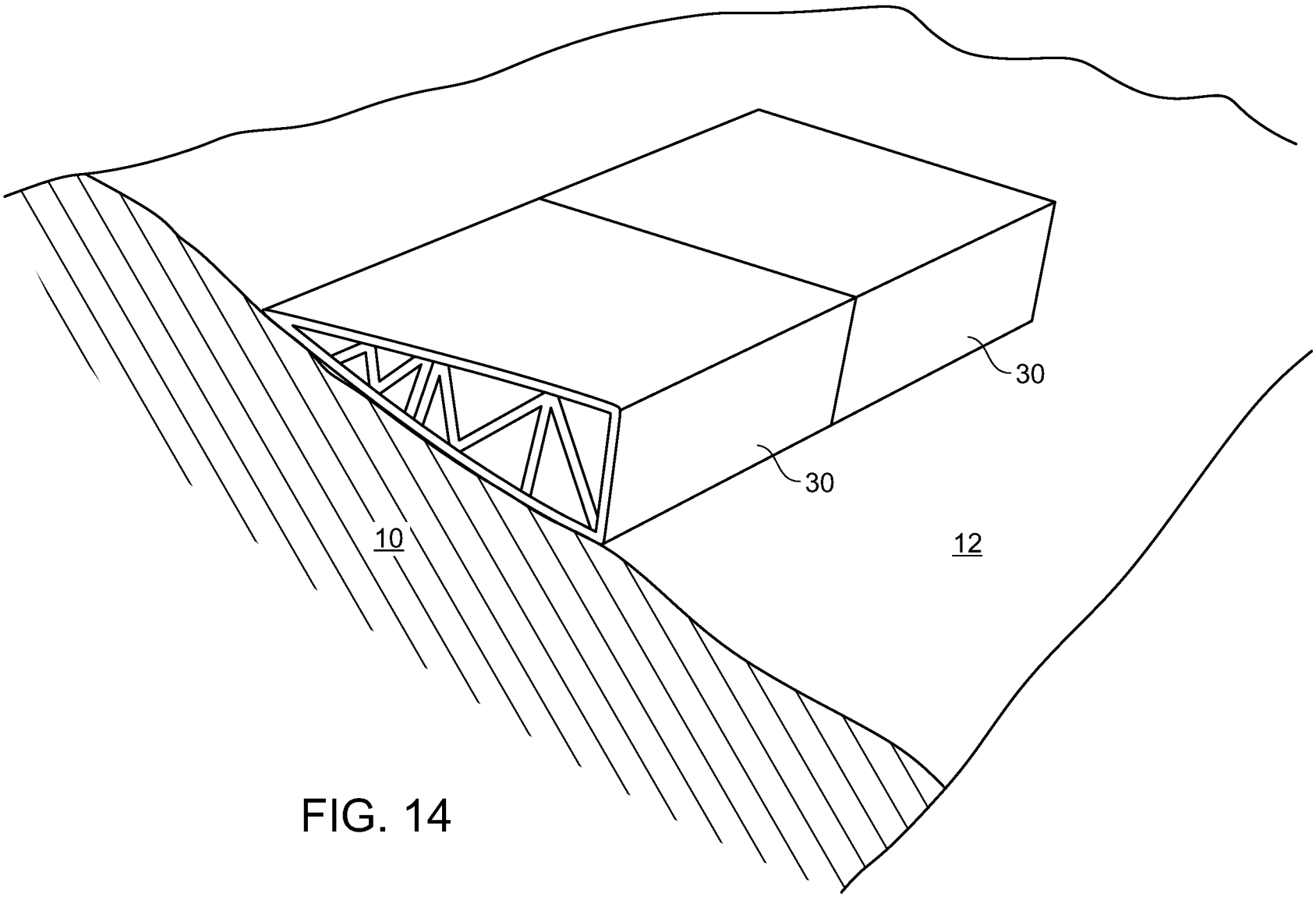
FIG. 14 is a perspective view showing two interlocking ramp sections for use in making a reinforced membrane-lined wall system in accordance with an example embodiment.

The trench, once excavated, will typically have sidewalls 18 and a bottom 16, as shown generally in the figures. As mentioned, the trench may be excavated on a slope, as shown in FIG. 3. If so, one or more interlocking leveling ramps 30 may be used to keep the excavator 20 substantially level during the excavation procedure. The interlocking leveling ramps 30 are also shown in FIG. 14. Since they are made in interlocking sections, ramps 30 can be disconnected from each other and continuously moved by workers as the trench excavation progresses, so that the trench can be made as long as needed, with each ramp section being moved successively to expose new sections of earth 10 to be excavated.

In an example embodiment, the trench 14 may be dug deep enough to extend into undisturbed, native soil 19, as shown in FIG. 5. Walls 80 extending to such depth and into native soil will typically have very good resistance to erosion by water action on the soil of earth 10 in the area to be reinforced.

If the soil to be excavated is not sufficiently firm, techniques and apparatus may be used to hold or press the sidewalls of the trench in place, such as air bladders or plates forced apart by hydraulic cylinders, for example.

Figure 15:
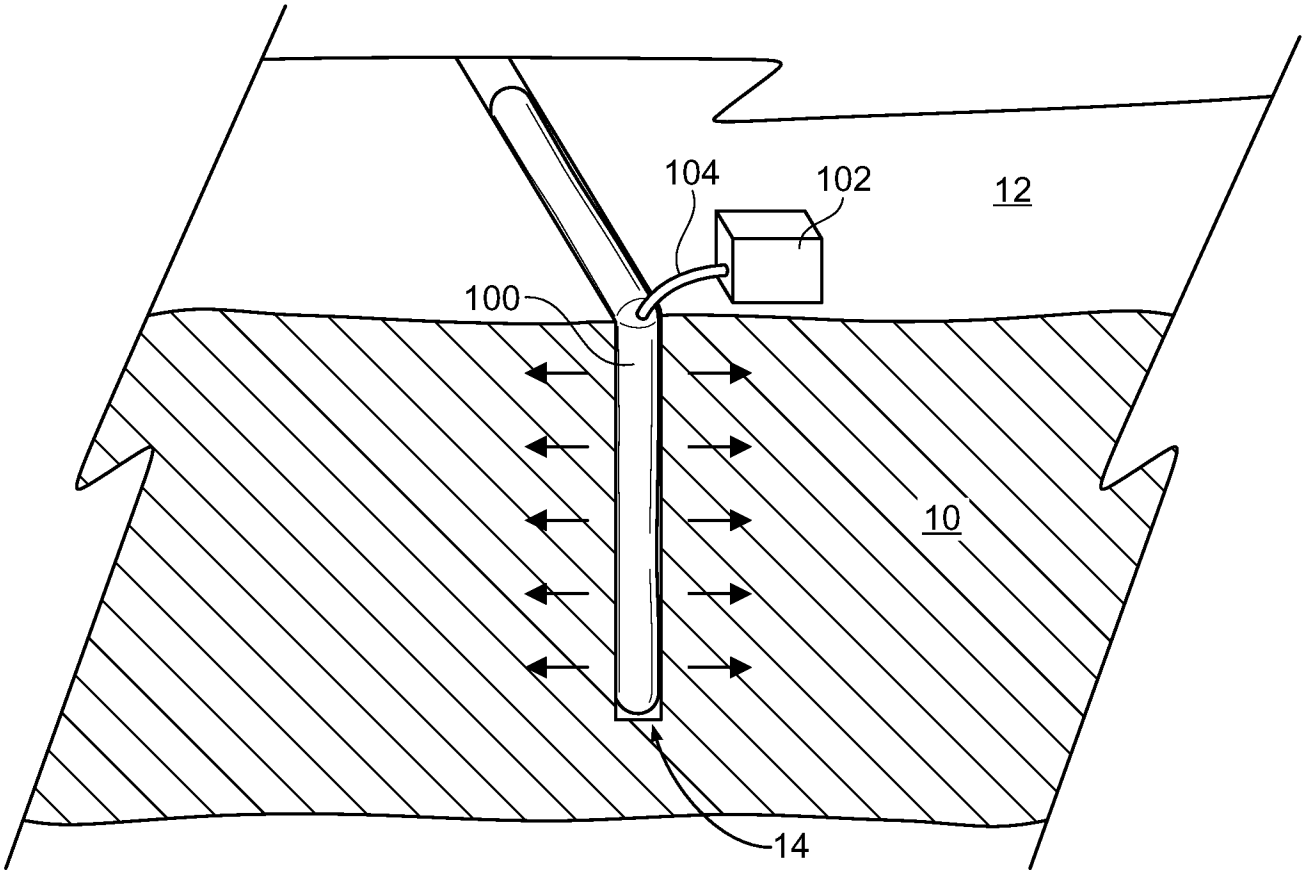
FIG. 15 is a perspective, sectional view of an excavated site with a force-applying apparatus in place in accordance with an example embodiment.

One such method and apparatus is best illustrated in FIGS. 15-19 and 21. As shown in FIG. 15, an air bladder 100, such as an air-lift cushion (which may be custom made to a size and shape appropriate for this application) may be installed in the excavated trench 14 to a first excavated depth of the trench. Then, the air-lift cushion 100 may be inflated with compressor 102 and hoses 104 to apply compression force (indicated by the arrows) to the side walls of the narrow trench, thereby preventing trench collapse. This allows the trench to be kept open without filling it with a Bentonite/water slurry, or other materials that could change the makeup of the material to be used for the wall. As discussed herein, the use of membrane 62 prevents soil or undesirable materials from the excavated ground from entering the trench 14, which results in a better wall and concrete/cementitious material of known and consistent composition and strength. Using the air bladders 100 or hydraulic cylinders 108 (see below) further aids that process by allowing trenches to be formed without using slurries or other materials to prevent collapse. As a result, the process described herein improves over walls that are a mixture of slurry, side-wall soils, and water (other than desired water within the cementitious mixture used to produce the wall).

If necessary (e.g., depending on soil conditions or other factors), rigid plates 106 may be used in addition to air bladders to compress the soil. Further, instead of air bladders, hydraulic cylinders 108 may be used to apply force to plates 106, as shown in FIG. 17, using hydraulic fluid under pressure supplied via hydraulic hoses 109. If cylinders 108 are used, they may be driven by a hydraulic pump 107. In any of these embodiments, compression force, as indicated by the arrows in FIGS. 15-17, may be applied to the sides of the trench 14 to prevent collapse.

Figure 16:
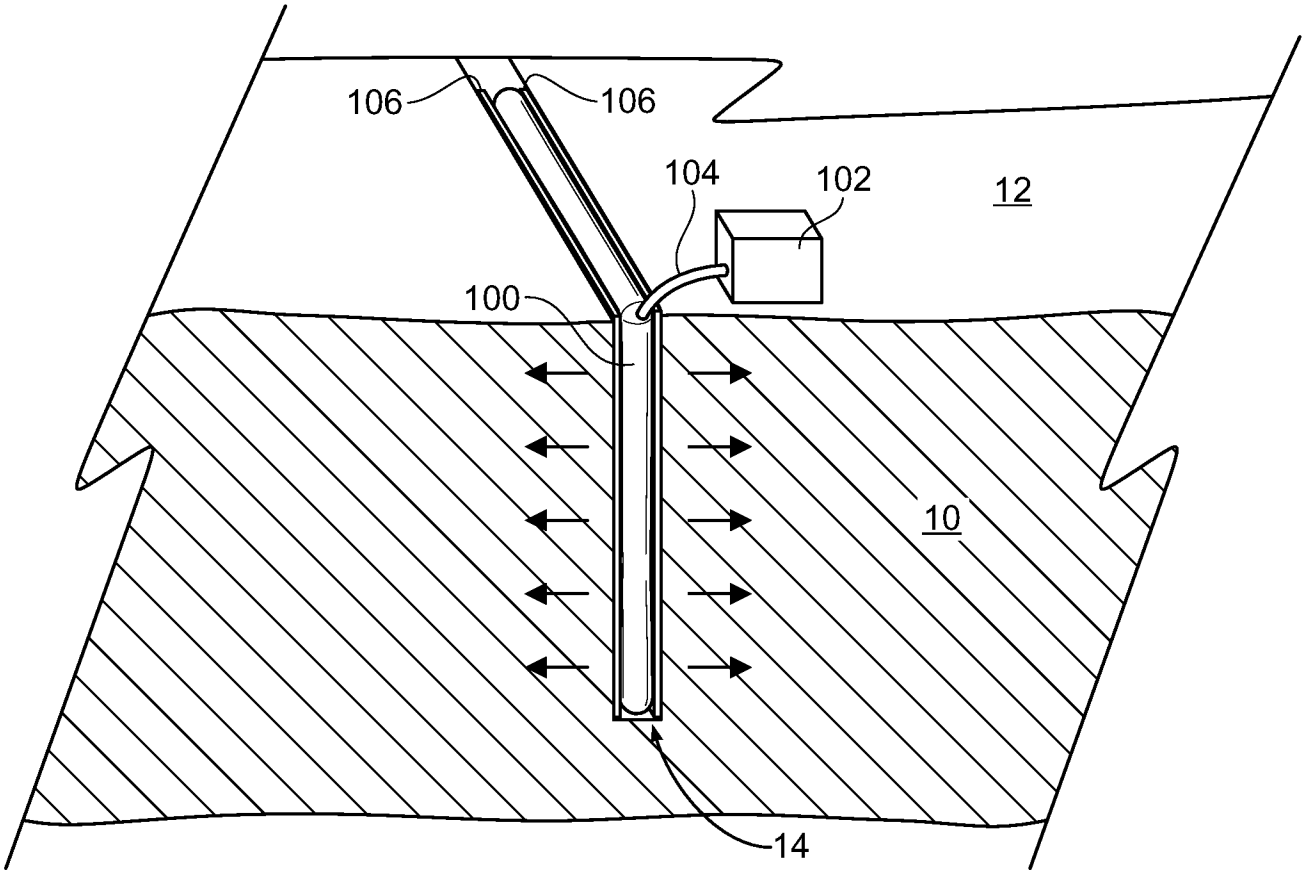
FIG. 16 is another perspective, sectional view of an excavated site with a force-applying apparatus in place in accordance with an example embodiment.
Figure 17:
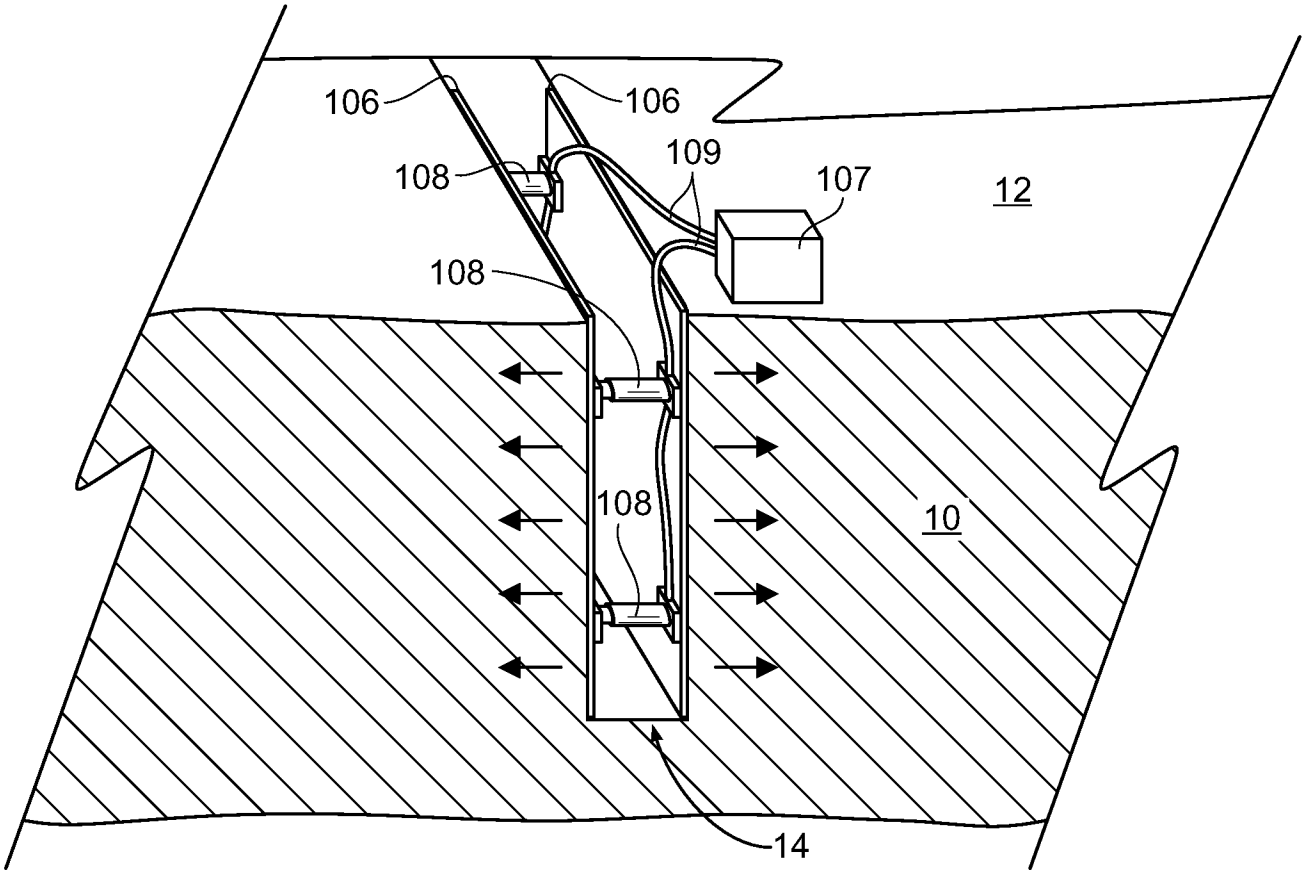
FIG. 17 is another perspective, sectional view of an excavated site with a force-applying apparatus in place in accordance with an example embodiment.
Figure 18:
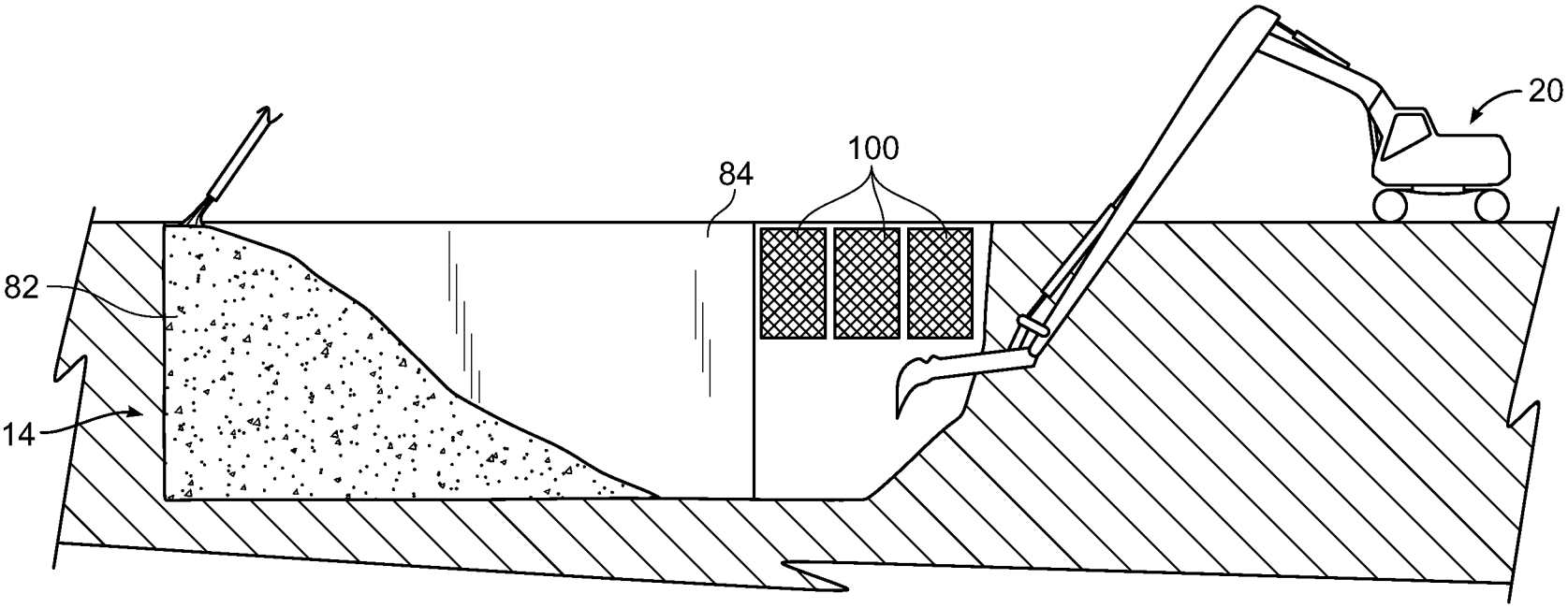
FIG. 18 is a sectional view of a trench being excavated and a reinforced membrane-lined wall being installed in accordance with an example embodiment.
Figure 19:
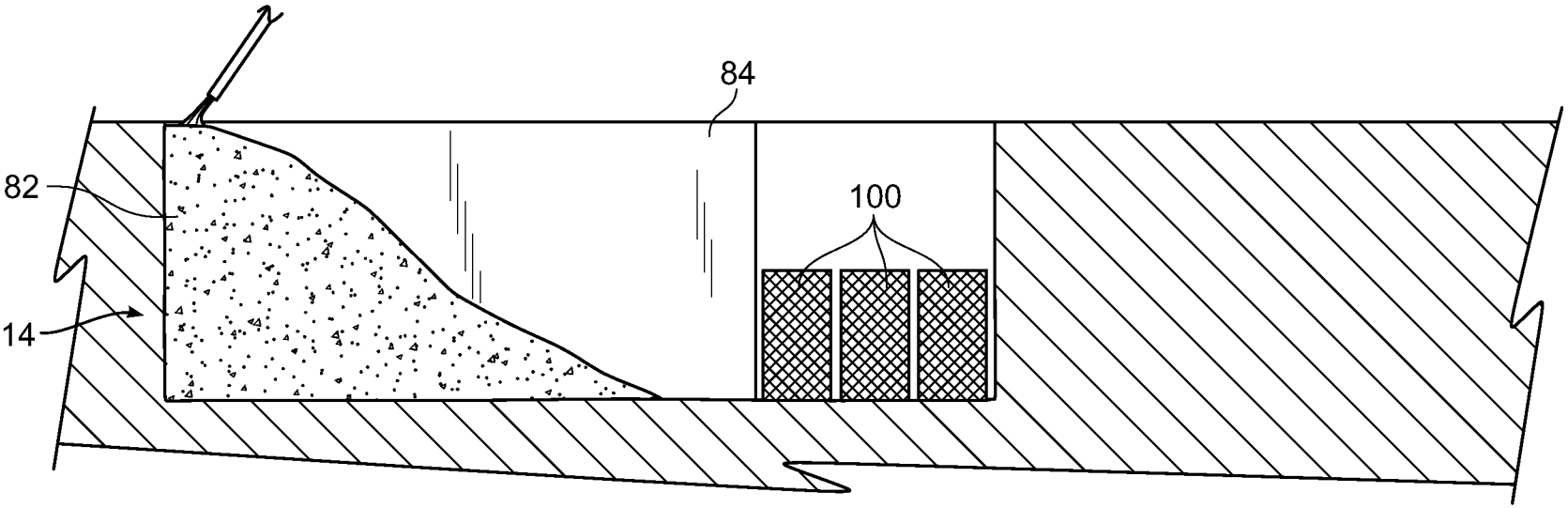
FIG. 19 is a sectional view of a trench with a force-applying apparatus in place and a reinforced membrane-lined wall being installed in accordance with an example embodiment.
Figure 20:
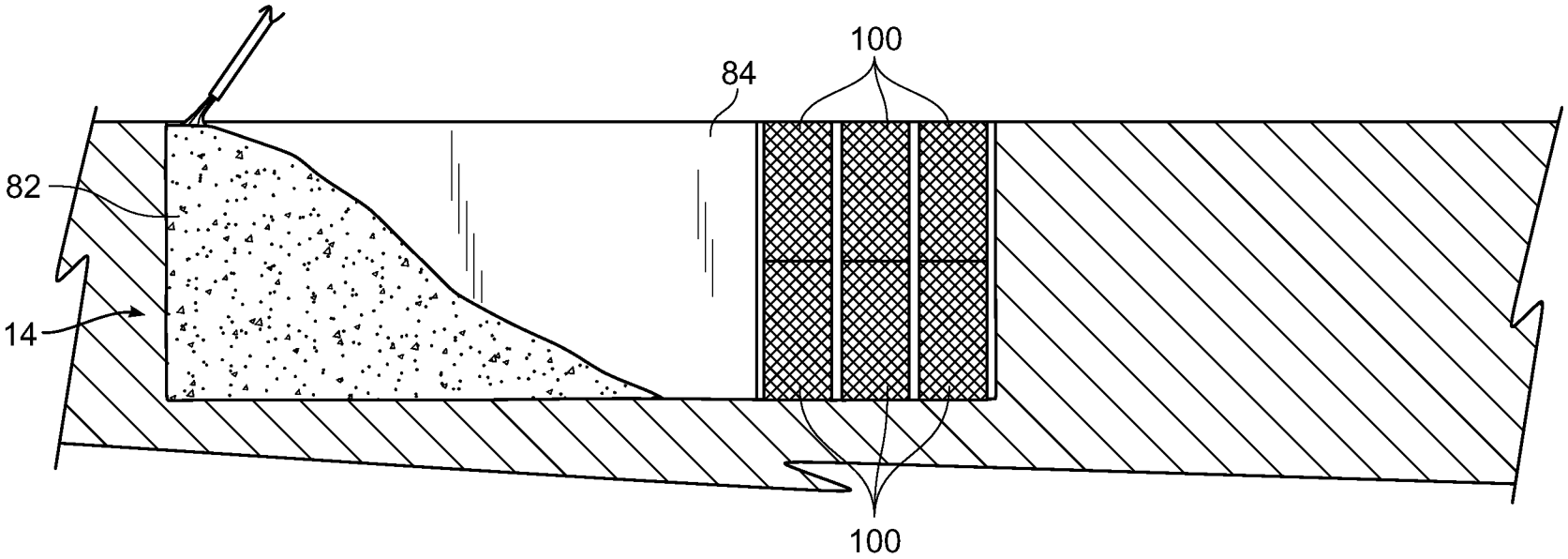
FIG. 20 is another sectional view of a trench with a force-applying apparatus in place and a reinforced membrane-lined wall being installed in accordance with an example embodiment.
Figure 21:
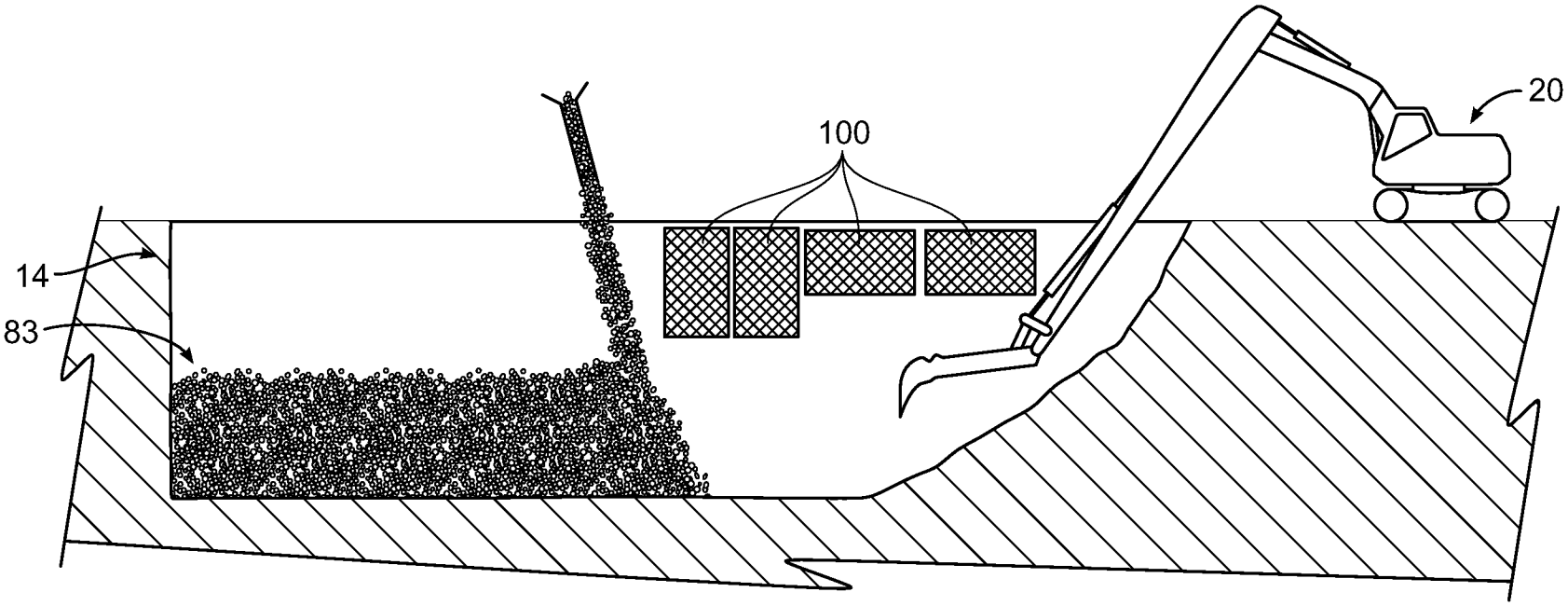
FIG. 21 is a sectional view of a trench being excavated and a weighted membrane-lined wall being installed in accordance with an example embodiment.

In creating a deeper trench, the trench may first be excavated to a given depth, for example, the depth shown in FIGS. 15-17. Next, a long boom/stick extension on an excavator 20 may be used to continue digging the trench deeper below a row of air-lift cushions 100 (or plates 106 used with air bladders or hydraulic cylinders), as shown in FIGS. 18 and 21. Leaving the cushions 100 or plates 106 in place during further, deeper excavation may or may not be necessary, depending on soil conditions. Further, air-lift cushions 100 or plates 106 may also be needed at a deeper level of the trench, as shown in FIG. 19. If it is necessary to leave the apparatus in place, that may be done at any or all levels as excavation continues. For example, as shown in FIGS. 18-20, once the trench 14 is excavated to the depth of two rows of air-lift cushions 100, the topmost row (FIG. 18) may be deflated, dropped down one level (FIG. 19), reinflated, and replaced with another row above it (FIG. 20). As mentioned above, replacing the row of cushions/plates that is moved down may not always be necessary, depending on soil conditions. This procedure may also be accomplished using the hydraulic cylinder embodiment discussed above.

Once the desired depth has been reached, the air-lift cushions 100 may be deflated and pulled out of the trench, so that the liner 62 and reinforcement layer 84 can be installed into the open trench as described herein. Notably, and again depending on soil conditions as observed during excavation/compression, it may not be necessary to immediately install the liner 62 and pour concrete for the wall, because it is possible that, once compressed, the sides of the trench may not quickly collapse even after the bladders 100 or plates 106 and cylinders 108 are removed.

FIGS. 18-20 illustrate the sequential process of excavating a trench and building a lined wall. For example, the figures shown cementitious material 82 being poured in a partially completed trench 14 after the trench has been excavated, the membrane or liner 62 (not shown) has been installed, and the reinforcement layer 84 has been installed. FIG. 21 illustrates the use of drainage rock 83 instead of cement for used with filter fabric for a different type of wall.

Figure 22:
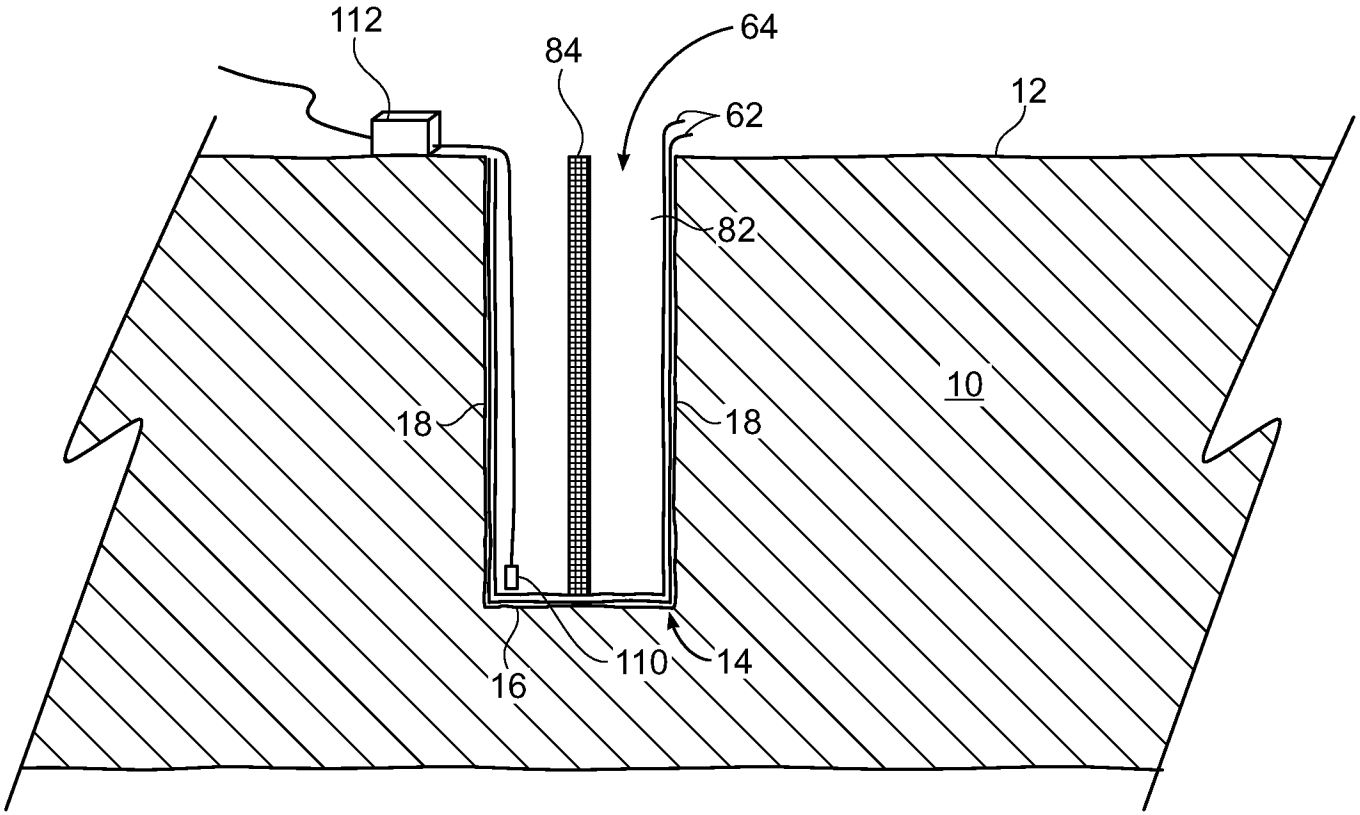
FIG. 22 is a sectional view of an excavated trench with a reinforced membrane-lined wall and a moisture sensor being installed in accordance with an example embodiment.
Figure 23:
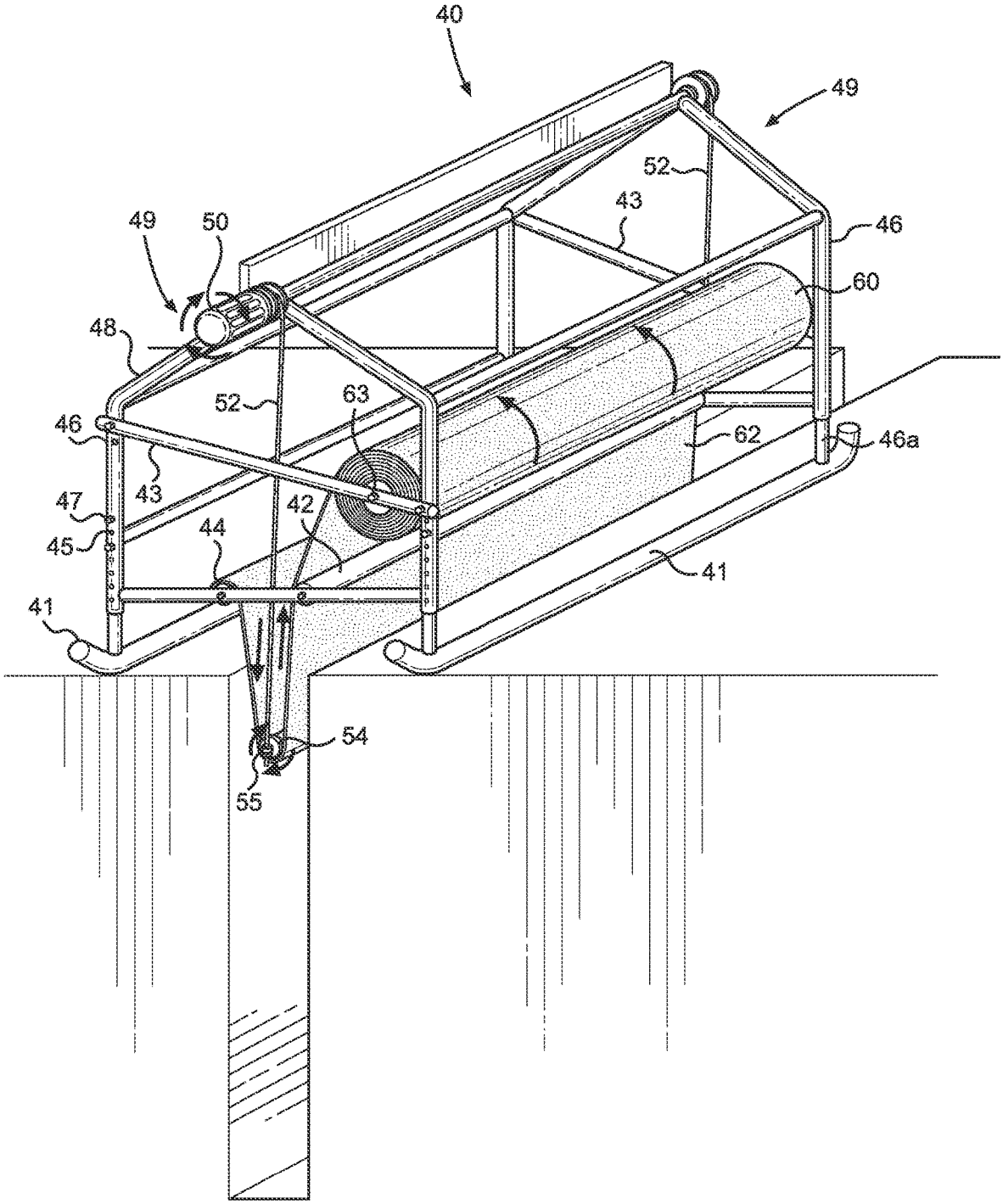
FIG. 23 is a perspective view of a liner installation sled in accordance with an example embodiment.
Figure 24:
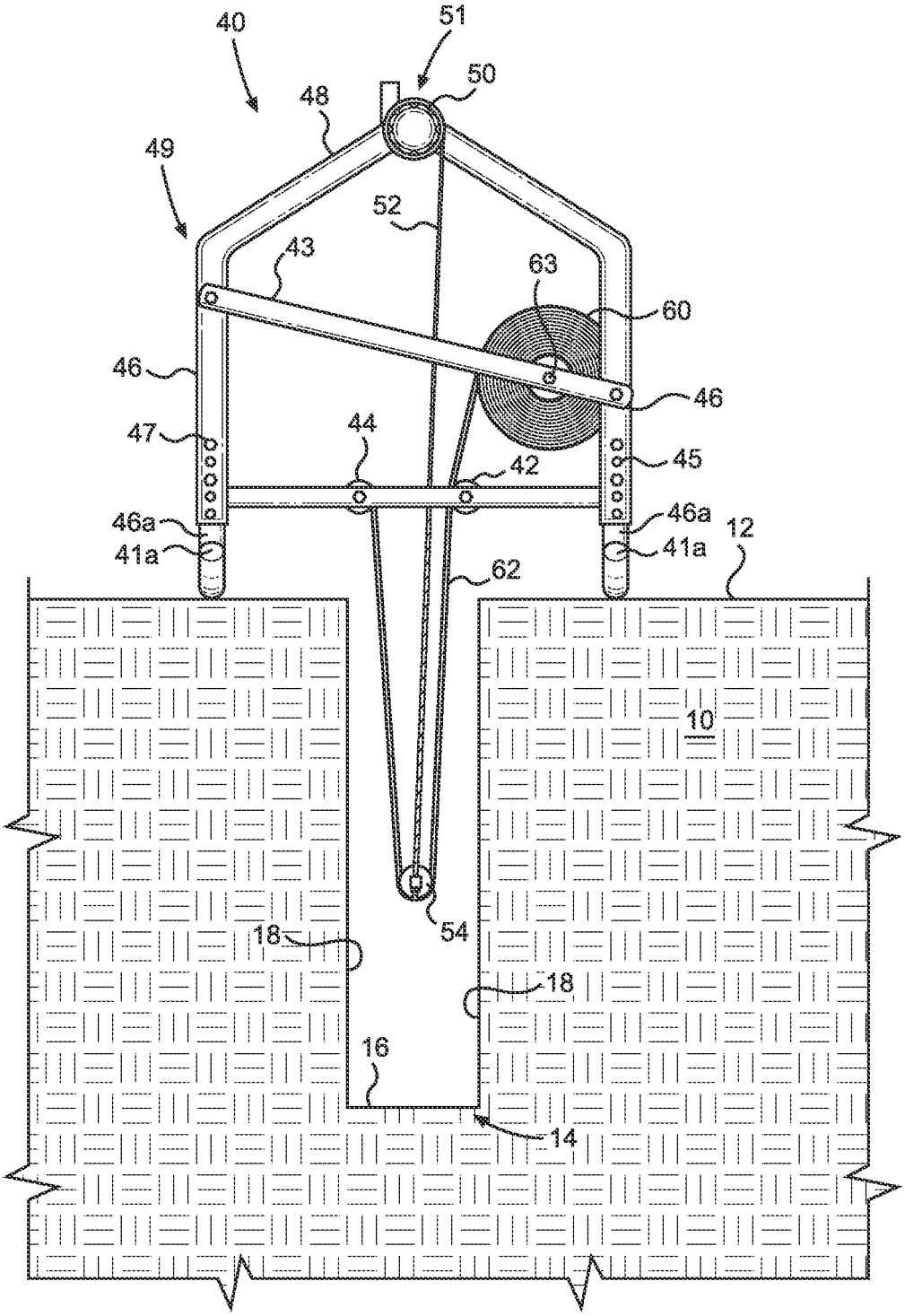
FIG. 24 is an end view of a liner installation sled in installation position over a trench in accordance with an example embodiment.
Figure 25:
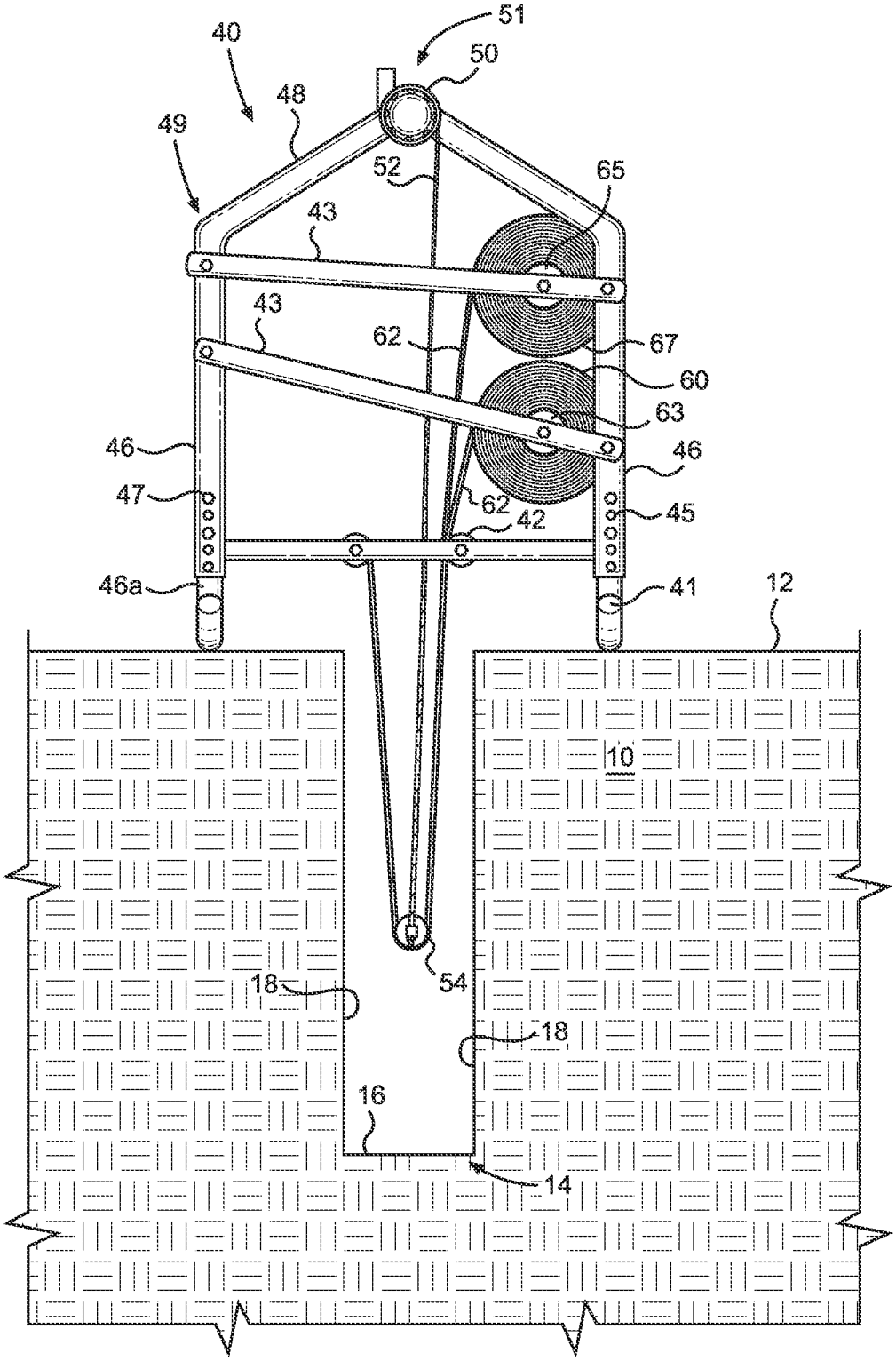
FIG. 25 is an end view of a liner installation sled in installation position over a trench in accordance with another an example embodiment.

After the trench 14 has been excavated, one or more sensors 110 may be installed at various locations within the interior portion 64 of the trench or liner 62, as shown in FIG. 22. Such sensors 110 can create smart walls that allow for remote monitoring of moisture leakage, vibration from tunneling, etc. Accordingly, sensor 110 may be a moisture sensor, a vibration sensor, or any other type of sensor usable to detect conditions within the lined wall. As also shown, the sensor 110 may be communicatively coupled to a control unit 112, which may be or comprise a radio or cellular device (similar to those used in remotely monitored alarm systems). The sensor 110 may be wired or wireless, and the control unit 112 may also use wired or wireless communications to monitor and report or provide the sensor status to a remote user.

For greater efficiency, it is possible to place or embed multiple sensors, of different types if desired, within the liner 62 or reinforcement layer 84. Further, the sensors 110 may be placed at different locations within the interior portion 64 of the trench or liner 62. For example, for moisture or vibration sensors 110, placement at or near the bottom of the trench 14 may be desirable, although any location in the trench/wall is possible. The placement of sensors 110 within the wall is possible and improved by the controlled, "dry" process of forming walls described herein.

C. Liner.

Figure 8:
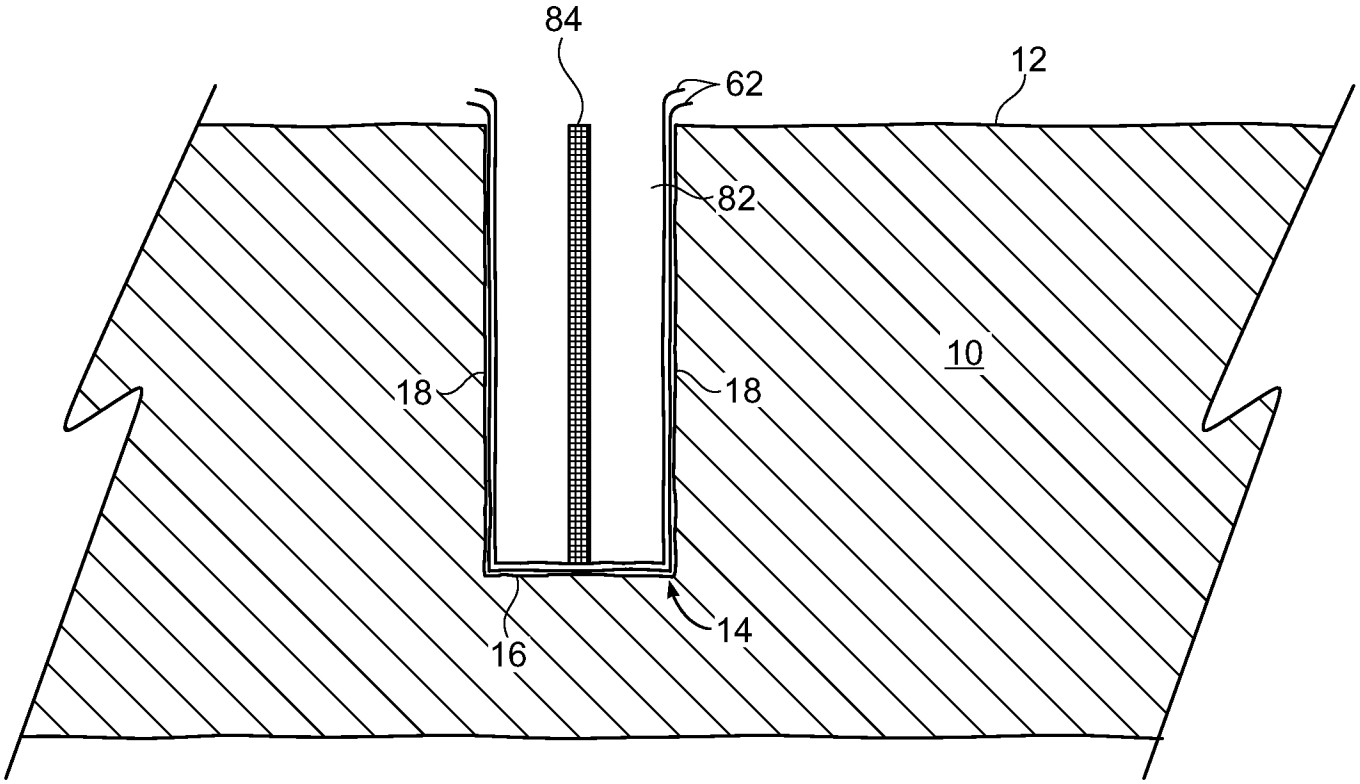
FIG. 8 is a sectional view of an excavated trench where a membrane-lined wall is to be installed in accordance with an example embodiment.
Figure 9:
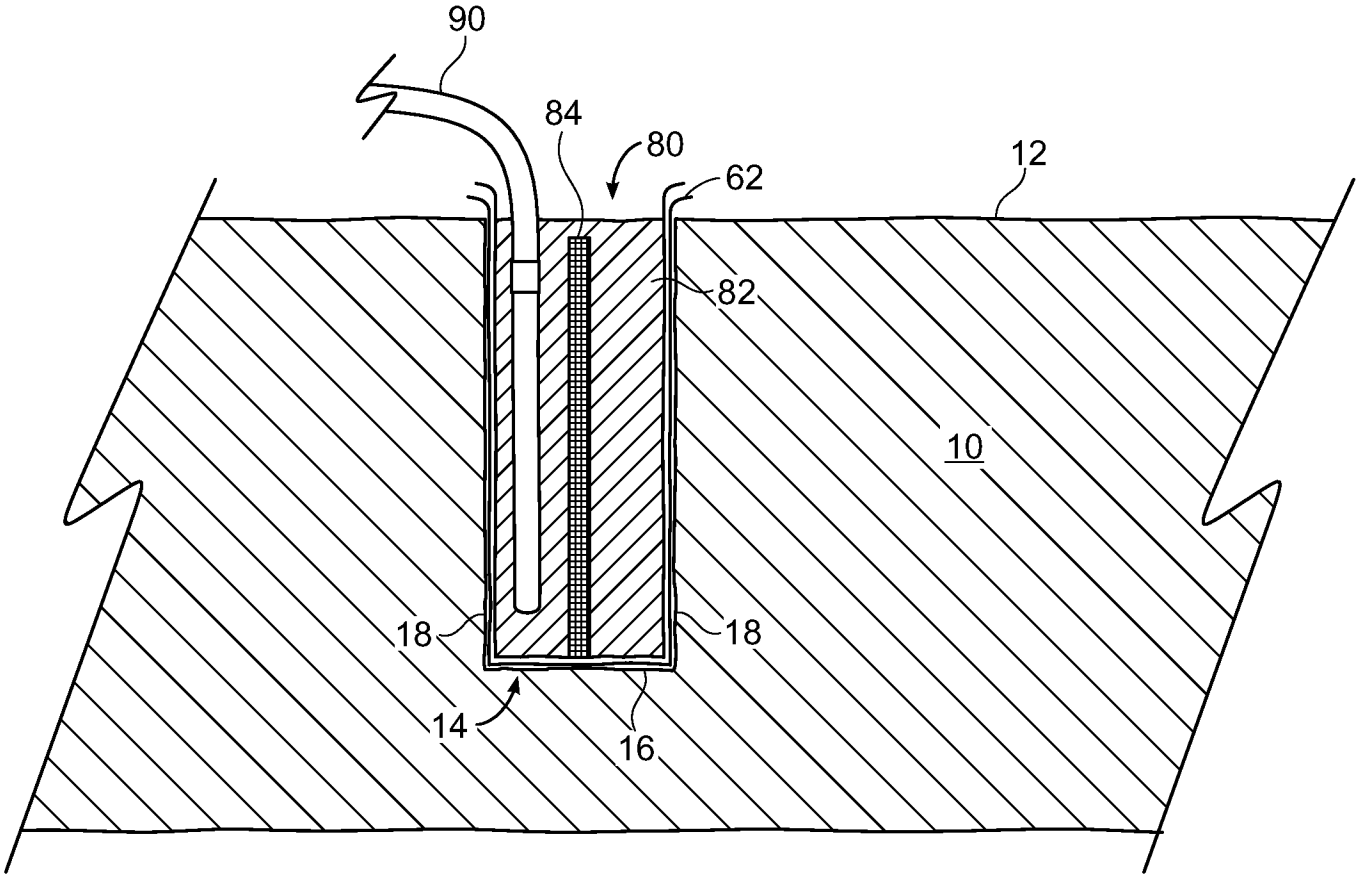
FIG. 9 is a sectional view of an excavated trench with a reinforced membrane-lined wall being installed in accordance with an example embodiment.
Figure 10:
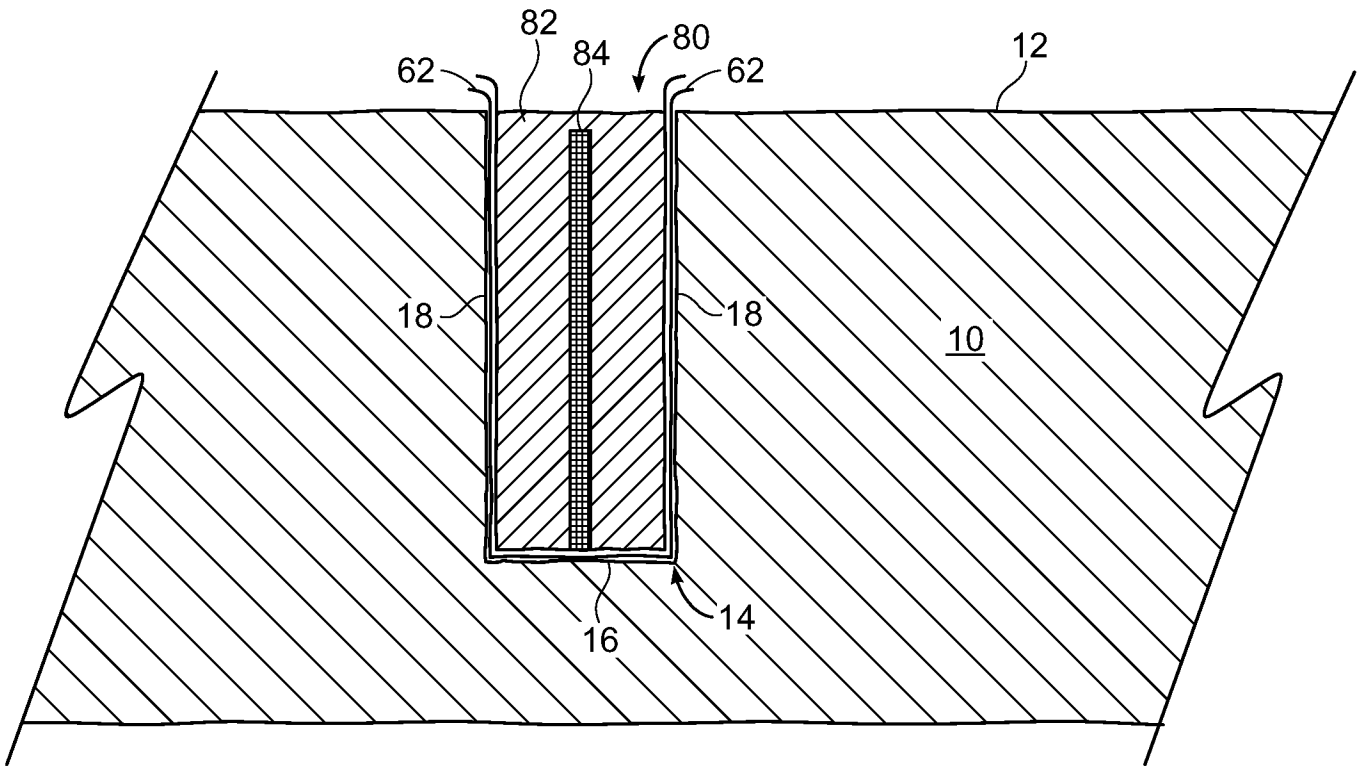
FIG. 10 is a sectional view of a reinforced membrane-lined wall in accordance with an example embodiment.

As best shown in FIGS. 8-10, the sides and bottom of the trench, and also the resulting wall, may be lined with one, and more preferably two, liner layers 62, to make the wall impermeable to water and other substances in the surrounding soil. As mentioned above, the liner 62 may be an impermeable HDPE geomembrane. This membrane may be a smooth HDPE liner, a textured HDPE liner, a composite liner (e.g., a combination of nonwoven or woven geotextiles with HDPE geomembranes), or other materials.

In addition to making the finished wall 80 more resistant to water flow and increased mitigation of internal water migration, the liner 62 also serves to prevent soil contamination in the concrete pour, ensuring competent concrete core integrity. In addition, the weight of the concrete tends to force the liner into close contact with the sides 18 of the trench, resulting in a tight seal to the sides 18 of the trench 14.

Figure 11:
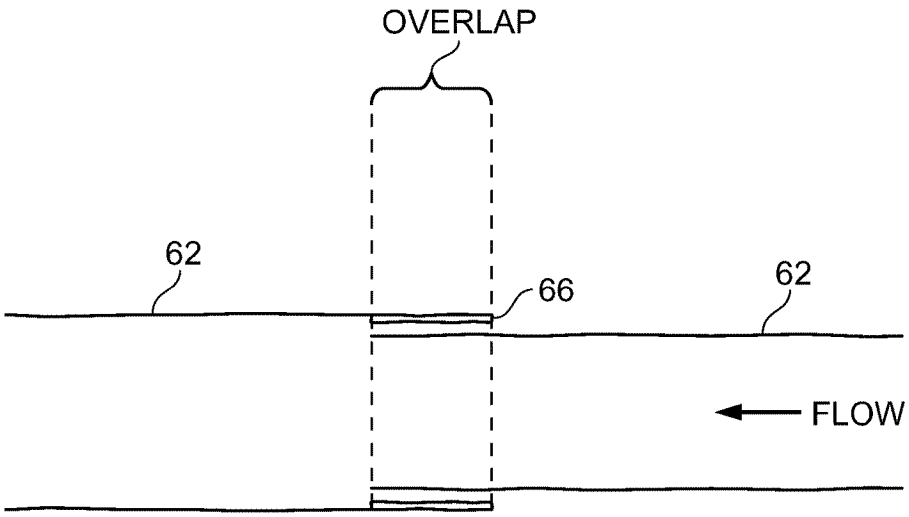
FIG. 11 is a top view of an inner liner layer for use with a reinforced membrane-lined wall in accordance with an example embodiment.
Figure 12:
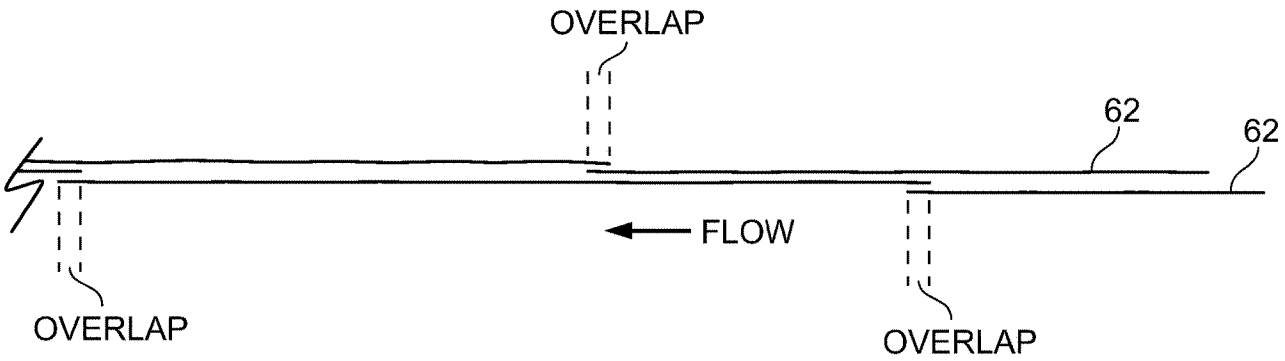
FIG. 12 is a top view showing two overlapping liner layers for use with a reinforced membrane-lined wall in accordance with an example embodiment.

As shown in FIGS. 11 and 12, the liner 62 may be made from multiple pieces of whatever liner material is used. This may be necessary, for example, for a wall 80 that is longer than the maximum available width of liner material. In that case, the liner may be overlapped at the edges. As an example, as shown in FIG. 11, the edges may have an overlap so that the innermost layer extends past the edge of the outer layer in the direction that cementitious material will flow when poured into the interior portion 64 of the liner. Because of this, weight of the material, such as concrete, will force the layers together before reaching the end of the first layer, so that the flow of material will not have a tendency to peel the layers apart, and will not tend to flow into the overlap area and out of the liner. Thus, the liner will tend to form a continuous barrier between the concrete and the sides 18 and bottom 16 of the trench 14. Moreover, because each section of liner 62 is pushed or forced into the trench 14 from a roll 60, 67 on one side of the trench and a fixed edge on the other, the liner forms a continuous, seamless barrier which isolated the interior portion of the trench along part of the length of the trench (e.g., a length equal or about equal to the width of the membrane material being used).

In addition, if desired, an adhesive layer 66 may be added to further seal the layers of liner 62 together. In addition to an inner layer, the liner 62 may also comprise a second, outer layer, as shown in FIG. 12. The outer layer may be installed in the trench with each layer being parallel, one atop of the other. This would be the result of using the installation technique and equipment best shown in FIG. 7. However, the outermost layer could also have its edges, which also have an overlap, spaced away from the edges of the inner layer, which may further inhibit any water flow or seepage between the layers that, together, form the overall liner 62 of the wall 80.

Installed as shown in FIG. 12, this layer placement can ensure a long, or maximum length, path for any water to reach the interior of the wall from the earth 10 outside of the liner 62. Together, as well as individually, the layers of the liner material form a substantially continuous and impermeable barrier, having a "U" shape (viewed in cross section), between the reinforced concrete portion of the wall, and the sides 18 and the bottom 16 of the trench. The inside of this barrier forms an interior portion 64 of the liner 62 and the trench 14.

D. Reinforcement Mat.

Figure 13:
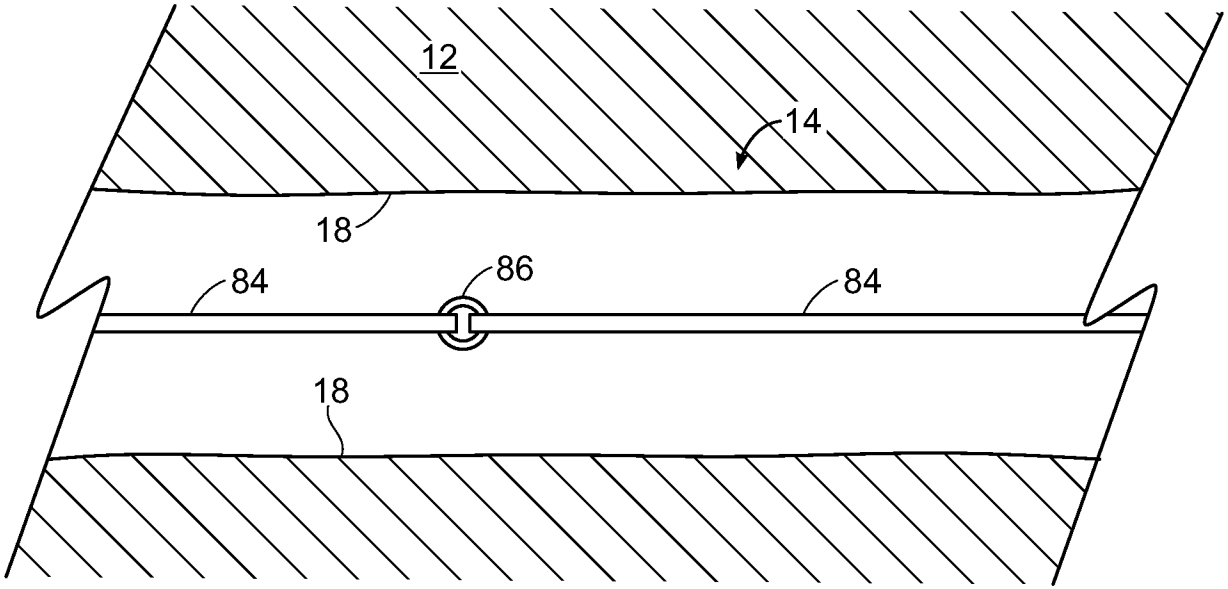
FIG. 13 is a top view showing two joined reinforcing mat sections for use with a reinforced membrane-lined wall in accordance with an example embodiment.

As best shown in FIGS. 8-10, a reinforcement layer 84, such as a galvanized steel reinforcement mat, may be installed in the trench after the liner 62 is in place. The reinforcement layer or mat 84 provides increased strength to the wall, and also increases the wall's resistance to seismic forces. If the wall 80 is to be larger, in any dimension, than the available sizes of the reinforcing mat material or other type of reinforcement, multiple pieces or sections of reinforcing mat may be used. For added strength, such sections or pieces can be joined together with a connector 86 before concrete is poured into the trench and liner. Any connection type may be used, and may include hog rings, bolts, wires, welding, etc. For fast joining, the sections may be joined together using a hog ring gun, which may result in the joined sections as shown in FIG. 13, which illustrates reinforcing mat 84 joined together with a hog ring or other connector 86.

E. Liner Installation Sled.

As best shown in FIGS. 6-7 and 24-28, a specialized liner installation sled 40 may be used to quickly and efficiently place or install the liner membrane 62 into the trench 14. As shown, the sled 40 has side frame members 46 to support the sled and associated elements. The sled 40 also includes top frame members 48, and all such members comprise a frame 49. As shown in FIGS. 23-26, for example, the frame 49 may include two or more support members 41 mounted on the frame, which are adapted, designed, and mounted such that the frame 49 can be movably supported on a surface 12 over a trench. The support members 41 may include members **46*a* that fit adjustably into side frame members 46, the use of which is described further below. Although skids are shown as the lower portion of support members 41**, other arrangements are possible, such as multiple wheels, tracks, etc.

The liner installation sled 40 may also include one, two or more liner rollers 63, 65 that are rotatably mounted on frame 49 by braces 43. The liner rollers may be or include an elongated member, such as a pipe or tube, or they may simply be rollers (including bearings or bushings, for example) that are adapted so that a central tube of a liner membrane can be mounted rotatably on each liner roller 63, 65. Because the liner rollers 63, 65 are designed and mounted on the frame 49 to easily rotate, roll 60 or 67 of liner material can readily be forced into the trench 14 when the liner installation sled is in an installation position (see, e.g., FIG. 25-26) over the trench 14. The liner rollers are mounted on the frame as shown so that they hold one or more rolls of liner above the surface on one side of the trench 14 (e.g., a "first" side).

The liner installation sled 40 may also include a positioning roller 42 mounted on the frame as shown so that liner/liners 62 pass over the positioning roller 42 and are guided into the trench 14 when the liner installation sled 40 is in the installation position as shown. The positioning roller may be an elongated member as well, and is typically rotatably mounted on the frame 49 by a bearing or bushing so that the liner 62 can roll over it with little resistance.

Figure 26:
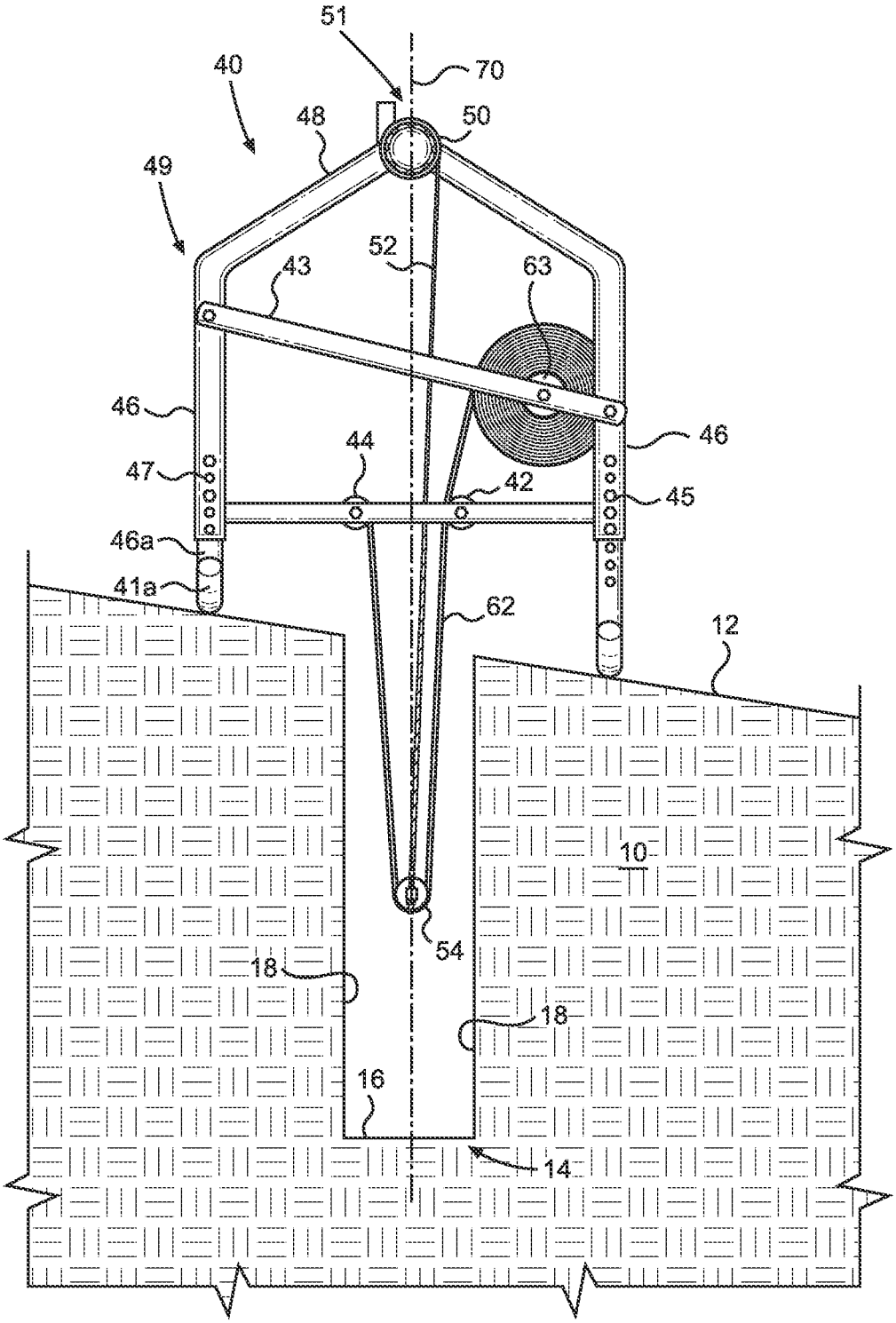
FIG. 26 is another end view of a liner installation sled in installation position over a trench on a sloped surface in accordance with an example embodiment.
Figure 27:
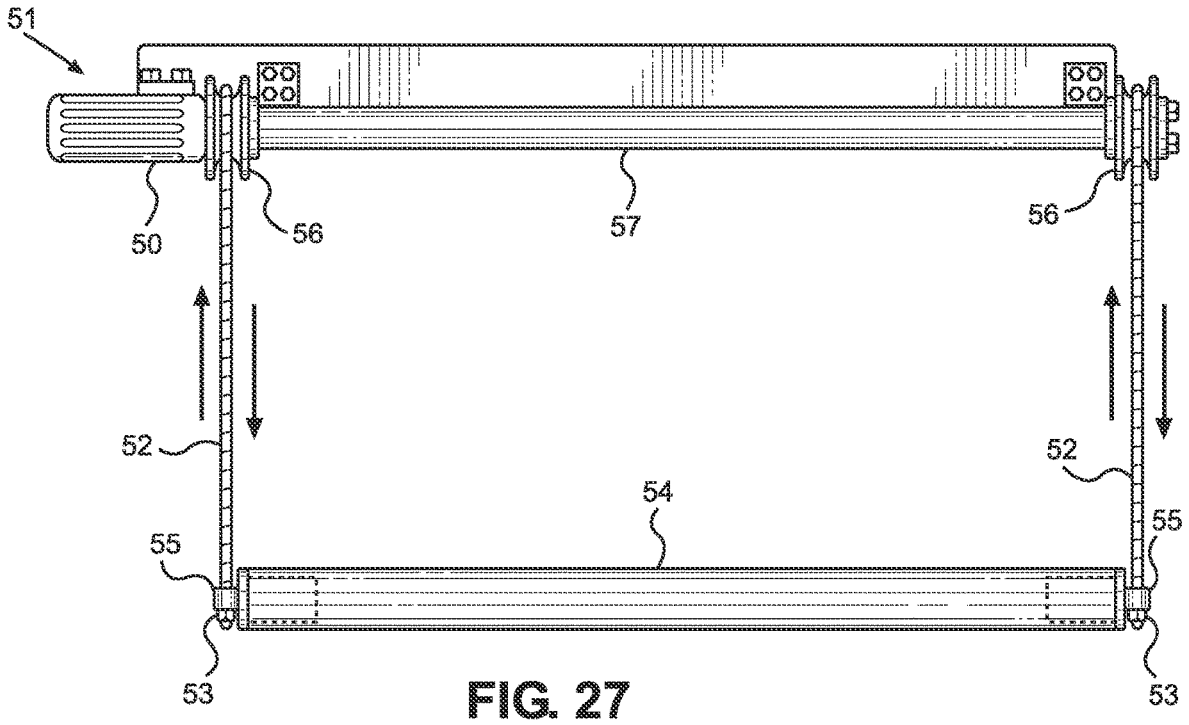
FIG. 27 is a side view of a weight suspension system of a liner installation sled in accordance with an example embodiment.
Figure 28:
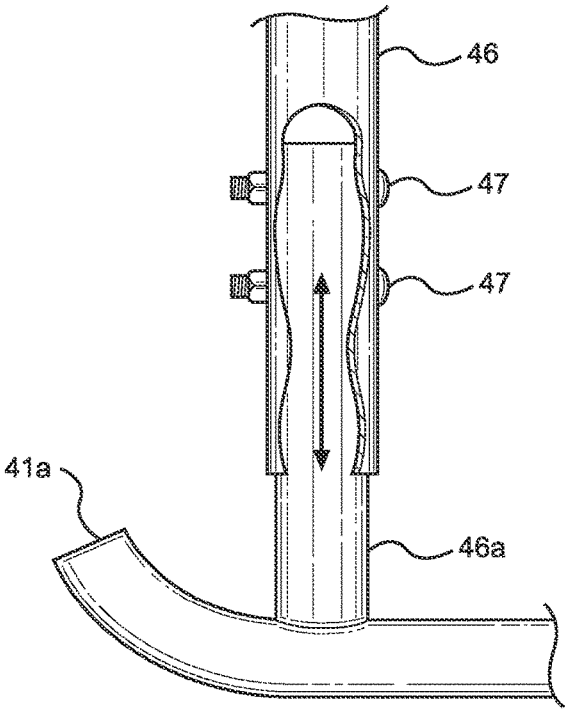
FIG. 28 is a detail view of a height adjustment mechanism of a liner installation sled in accordance with an example embodiment.

For use on the sloping berm of a levee (or other sloping surface where a wall is needed), the side frame members 46 may be made to be adjustable, by moving members 46 into or out of members 46, as shown in FIG. 28. As shown, the members 46*a* on one side of the sled 40 can be moved by first removing bolts 47 and lining up a different set of holes on members 46 and 46*a*, and then reinstalling bolts 47 so that, if needed, the sled 40 can be used on a slope. As shown in FIG. 26, the length adjustment can be made so that a centerline 70 of the liner installation sled 40 remains directly above the trench 14, and so that the upper portion of the sled 40 remains level even though the bottom skids are not even.

Figure 7:
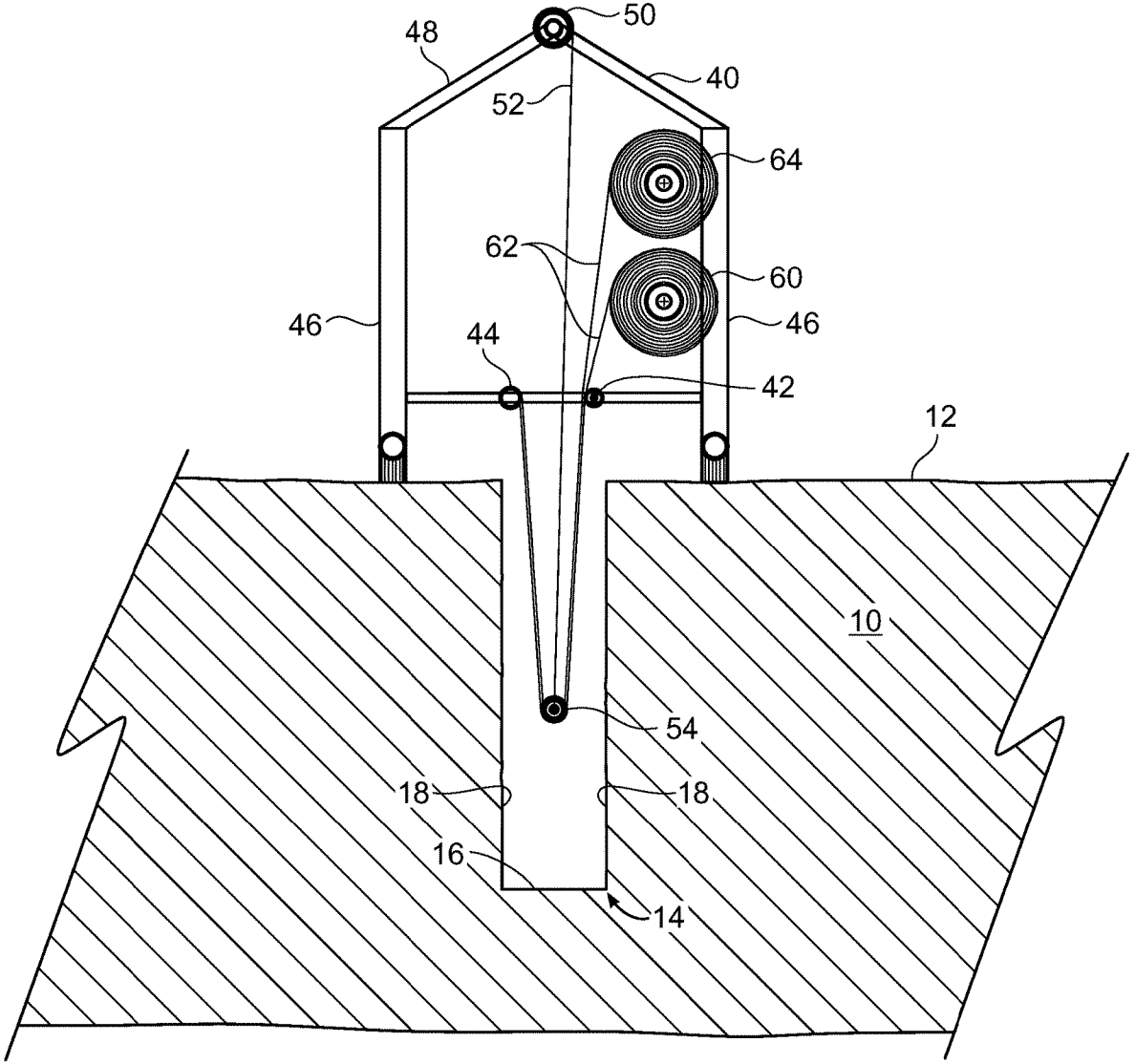
FIG. 7 is a sectional view of two layers of liner material being installed in an excavated trench where a membrane-lined wall is to be installed in accordance with an example embodiment.

As also shown, the sled 40 may have provision for mounting one or more large rolls 60, 67 of geomembrane liner material 62, in position above and to one side of the trench 14. As shown in FIG. 7, the sled may accommodate two rolls 60, 67 of geomembrane, one above the other. The rolls are supported vertically, but are allowed to rotate, so that with little force, the membrane material can unroll from the sled 40. With this sled, two layers of liner material 62 may be installed at the same time. The sled 40 may also include a positioning roller 42, a liner end clamp 44, a winch 50, and one or more winch cables 52.

As shown, the liner installation sled 40 is designed to hold one or more layers of liner 62 in position over the trench. Initially, the liner 62 extends over the trench 14 between the positioning roller 42 and the liner end clamp 44. The liner end clamp 44 may be or comprise a cylindrical shaft, mounted on the frame 49 such that it is aligned with the trench 14 along its length when the sled 40 is in the installation position. The end clamp 44 may be fixed or rotatable, and may take several forms. For example, the liner end clamp 44 may have a longitudinal slit adapted to receive the edge of one or both liners 62, and then may be clamped in place by screws, wedges, toggle clamps, etc. The liner end clamp 44 may also be or comprise a rotating cylinder with a ratcheting mechanism, so that the clamp 44 can be rotated in one direction only, wrapping liner material 62 around the cylinder so that it holds itself in place when tension is put on the liner 62.

Once the liner is positioned over the trench 14, a user may activate winch 50 (which may be a power winch or a manual winch) to lower an elongated weight 54, such as a lead pipe weight, into the trench 14. The winch 50 or other mechanism is part of the weight suspension system 51, which is shown in more detail in FIG. 27. The system 51 may include two reels 56 at opposite ends of sled 40, connected by a connecting shaft 57. Accordingly, activating the winch or turning reels 56 will lower cable 52 at both ends, lowering the elongated weight 54 (which may be a pipe, for example) into the trench. The elongated weight 54 may be attached to cables 52 by one or more bearings 55, to allow the weight to rotate when it is used to force liner material into the trench. As indicated by the arrows in FIG. 23, for example, the bearings 55 allow the elongated weight 54 to rotate under the liner 62 as the liner moves down into the trench.

Lowering the elongated weight 54 will cause the liner roll 60, or both the upper and lower liner rolls 60, 67 (FIG. 7) to unroll, so that the liner 62 drops into the trench 14 in the shape of a "U" or "V", creating an interior portion 64 or pocket, as shown, to create a continuous barrier between the interior portion 64 and the sides 18 and bottom 16 of the trench 14.

F. Operation of Preferred Embodiment.

In use, the desired location of a trench 14 may be determined, where a wall can best reinforce or prevent leakage in a levee, or wherever such a wall is needed to prevent water migration, contain pollution, etc. In just one example use, a membrane-lined wall 80 can be formed along the top of a levee, as best shown in FIG. 5, although the wall can also be formed on the slope of a levee's berm, as shown in FIG. 3. Once the desired location is determined, the trench 14 may be excavated from the surface 12 of earth 10 using an excavator 20, which may be a long-boom excavator, for example. For deeper trenches, other machines and techniques may be used as well. As discussed above, one or more interlocking leveling ramps 30 may be used to keep the excavator 20 substantially level while a trench is being dug. The interlocking leveling ramps 30 can be disconnected and continuously moved by workers as the trench excavation progresses, with each ramp section being moved successively to expose new sections of earth 10 to be excavated.

Once the trench has been dug, the liner installation sled 40 is used to hold the layer or layers of liner 62 in position over the trench 14 and the sled 40 and winch 50 are used as discussed above to lower a rotatably-mounted weight 54 into the trench, causing the liner roll or rolls 60, 67 to unroll and the liner 62 to drop into the trench 14, creating an interior portion 64 or pocket, as shown, to create an impermeable barrier between the interior portion 64 and the sides 18 and bottom 16 of the trench 14.

In an example embodiment, the trench 14 may be deep enough to extend into undisturbed, native soil 19, as shown in FIG. 5. Walls 80 extending to such depth and into native soil will typically have very good resistance to erosion by water action on the soil of earth 10 in the area to be reinforced.

The liner 62 may, in an example embodiment, be lowered into trench 14 in a predetermined way, so that any overlapping portions of liner will resemble the overlap patterns shown in FIGS. 11 and 12. As shown in FIG. 12, the overlaps can be arranged and spaced so that the overlaps of the outer layer of liner 62 is at a maximum distance in either direction from the overlaps of the inner layer. This arrangement ensures that any water that might seep in between the layers of the outer layer will have to travel a maximum distance to reach the edge of an inner layer. The weight of the concrete when it is poured will tend to force the liner into close contact with the walls 18 and bottom 16 of the trench 14, so that a tight seal between the liner 62 and the sides and bottom of the trench is ensured, which can minimize or eliminate water entry into the wall system.

Once the liner 62 is in place within the trench, reinforcement mat 84 is installed within the interior portion 64 created by the liner. Typically, the reinforcement mat 84 will have a length aligned with the length of the trench, and a height aligned with the two sides of the trench. The mat will typically be positioned within the trench in the position shown in FIG. 8, and will eventually be surrounded by the cementitious material 82 of wall 80.

Next, concrete or other cementitious material 82 can be poured into the trench 14. For example, the material 82 can be poured from one end of the trench and allowed to flow into the trench in one direction, indicated by the arrows in FIGS. 11 and 12. With the flow in the direction shown, the flow of heavy cementitious material 82 will tend to close the overlapping edge of the inner layer, since it will already be exerting outward pressure against both layers (see, e.g., FIG. 11) by the time it reaches the overlapped edge of the innermost liner layer. Thus, the material 82 will not tend to flow between the two overlapping layers, as it might if allowed to flow in the opposite direction.

After the concrete or other material 82 is poured, but before it cures, an internal vibrator 90 may be used to effect a good cure, by removing or minimizing air within the concrete mixture. As is known, typically an internal vibrator may be repeatedly inserted (as shown in position in FIG. 9) into the concrete and then withdrawn at a controlled rate, which allows and causes the air in the concrete mixture to rise to the surface, rather than being held within the mix while the concrete hardens, creating "honeycombs." The vibrator 90, or multiple such vibrators 90 can be repeatedly inserted and withdrawn at various points along the length of the wall, after the concrete is poured, to reduce or eliminate trapped air. Thus, using the vibrator 90 causes the concrete to have greater strength and integrity. In addition to the separate vibrator 90 shown in FIG. 9, it would also be possible to vibrate the reinforcement mat 84 to achieve the same or a similar effect.

Unless otherwise defined, all technical and scientific terms used herein have the same meaning as commonly understood by one of ordinary skill in the art to which this invention belongs. Although methods and materials similar to or equivalent to those described herein can be used in the practice or testing of the system and method for installing a membrane-lined wall, suitable methods and materials are described above. All publications, patent applications, patents, and other references mentioned herein are incorporated by reference in their entirety to the extent allowed by applicable law and regulations. The system and method for installing a membrane-lined wall may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A liner installation sled adapted for being positioned above a trench having a length, the liner installation sled comprising:

a frame;

at least two support members mounted on the frame, the at least two support members adapted to movably support the frame on a surface over the trench;

a liner roller rotatably mounted on the frame, the liner roller adapted to hold a roll of a liner above the surface on a first side of the trench when the liner installation sled is in an installation position relative to the trench, wherein a longitudinal axis of the roll of the liner is aligned with the length of the trench;

a weight suspension system mounted on the frame and adapted to movably suspend an elongated weight that can be lowered into the trench and raised out of the trench, wherein the elongated weight is aligned with a vertical centerline of the frame; and a liner end clamp mounted on the frame to hold an edge of the liner above the trench, wherein the liner end clamp is mounted so that it is alignable with the length of the trench;

wherein the elongated weight is usable with the weight suspension system to force a portion of the liner into the trench.

2. The liner installation sled of claim 1, further comprising a positioning roller mounted on the frame and positionable above the trench such that the liner will move from the roll and over the positioning roller when the elongated weight is lowered into the trench.

3. The liner installation sled of claim 2, wherein the positioning roller is rotatably mounted on the frame such that it can rotate due to the liner moving over the positioning roller.

4. The liner installation sled of claim 2, wherein the elongated weight is rotatably suspended from the weight suspension system such that the elongated weight can rotate when the elongated weight is lowered due to the liner moving around the elongated weight.

5. The liner installation sled of claim 1, wherein the elongated weight is rotatably suspended from the weight suspension system such that the elongated weight can rotate when the elongated weight is lowered due to the liner moving around the elongated weight.

6. The liner installation sled of claim 1, wherein the weight suspension system comprises two reels, one at each end of the frame, wherein each reel is adapted to raise and lower a cable attached to an end of the elongated weight.

7. The liner installation sled of claim 6, wherein each cable is rotatably attached to the elongated weight such that the elongated weight can rotate when the elongated weight is lowered due to the liner moving relative to the elongated weight.

8. The liner installation sled of claim 1, wherein the liner end clamp comprises a shaft.

9. The liner installation sled of claim 1, wherein the liner end clamp is mounted so that it is positioned above the surface on a second side of the trench when the liner installation sled is positioned in the installation position relative to the trench.

10. The liner installation sled of claim 1, wherein the at least two support members are adjustably mounted on the frame such that the frame can be supported on the surface when the surface is sloped, wherein the frame is alignable by adjustment of at least one of the at least two support members such that the centerline of the frame is above the trench when the liner installation sled is positioned in the installation position relative to the trench.

11. The liner installation sled of claim 1, wherein the at least two support members comprise skids to allow movement of the liner installation sled on the surface over the trench.

12. The liner installation sled of claim 1, further comprising:

a second liner roller rotatably mounted on the frame, the second liner roller adapted to hold a second roll of a second liner above the surface on the first side of the trench, wherein a longitudinal axis of the second roll is aligned with the longitudinal axis of the liner roller;

wherein the liner end clamp is also adapted to hold a second edge of the second liner above the trench; and wherein the elongated weight is also usable to force a portion of the second liner into the trench.

13. A method of using the liner installation sled of claim 1, wherein the trench has two sides and a bottom, the method comprising:

positioning the liner installation sled in the installation position relative to the trench such that the longitudinal axis of the liner roller is aligned with the length of the trench above the surface on the first side of the trench;

holding the edge of the liner with the liner end clamp such that the edge is also aligned with the length of the trench, above the surface on a second side of the trench; and forcing the portion of the liner between the edge and the roll into the trench using the elongated weight such that the liner is supplied from the roll and extends into the trench to form a continuous, seamless barrier between the two sides and the bottom of the trench and an interior portion of the liner.

14. The method of claim 13, further comprising:

filling at least part of the interior portion of the liner with a cementitious material that surrounds a reinforcement mat within the interior portion of the liner;

wherein a weight of the cementitious material forces the liner into contact with the two sides of the trench; and allowing the cementitious material to harden.

15. The method of claim 14, wherein the cementitious material surrounds the reinforcement mat on at least three sides.

16. The method of claim 14, wherein the reinforcement mat comprises multiple pieces of reinforcement material joining together at an edge of each piece, wherein each piece is linearly aligned with each adjacent piece.

17. The method of claim 16, further comprising:

installing a reinforcement mat within the interior portion of the liner before filling at least part of the interior portion of the liner with the cementitious material, the reinforcement mat having a length aligned with the length of the trench, and having a height aligned with the two sides of the trench.

18. The method of claim 16, further comprising:

applying vibration to the cementitious material before it hardens.

19. A liner installation sled adapted for being positioned in an installation position relative to a trench having a length, the liner installation sled comprising:

a frame;

at least two support members mounted on the frame, the at least two support members adapted to movably support the frame on a surface over the trench;

a first liner roller rotatably mounted on the frame, the first liner roller having a first longitudinal axis that is aligned with the length of the trench and being adapted to hold a first roll of a first liner above the surface on a first side of the trench when the liner installation sled is in the installation position relative to the trench;

a second liner roller rotatably mounted on the frame and being adapted to hold a second roll of a second liner above the surface on the first side of the trench when the liner installation sled is in the installation position relative to the trench;

a weight suspension system mounted on the frame and adapted to movably suspend an elongated weight that can be lowered into the trench and raised out of the trench, wherein the elongated weight is aligned with a vertical centerline of the frame; and a liner end clamp mounted on the frame to hold a first edge of the first liner and a second edge of the second liner above the trench, wherein the first edge and the second edge are both alignable with the length of the trench;

wherein the elongated weight is usable with the weight suspension system to force a portion of the first liner and the second liner into the trench.

20. A liner installation sled adapted for being positioned in an installation position relative to a trench having a length, the liner installation sled comprising:

a frame;

at least two support members mounted on the frame, the at least two support members adapted to movably support the frame on a surface over the trench;

a first liner roller rotatably mounted on the frame, the first liner roller having a first longitudinal axis that is aligned with the length of the trench and being adapted to hold a first roll of a first liner above the surface on a first side of the trench when the liner installation sled is positioned in the installation position relative to the trench;

a second liner roller rotatably mounted on the frame and being adapted to hold a second roll of a second liner above the surface on the first side of the trench when the liner installation sled is in the installation position relative to the trench;

a weight suspension system mounted on the frame and adapted to movably and rotatably suspend a rotatable elongated weight that can be lowered into the trench and raised out of the trench, wherein the elongated weight is aligned with a vertical centerline of the frame;

a positioning roller rotatably mounted on the frame such that the first liner and the second liner will roll over the positioning roller when the rotatable elongated weight is lowered into the trench; and a liner end clamp mounted on the frame to hold a first edge of the first liner and a second edge of the second liner above the trench, wherein the first edge and the second edge are both alignable with the length of the trench and wherein the liner clamp is mounted so that it is positioned above the surface on a second side of the trench when the liner installation sled is in the installation position relative to the trench;

wherein the rotatable elongated weight is usable with the weight suspension system to force a portion of the first liner and a portion of the second liner into the trench, wherein the rotatable elongated weight will rotate when it forces the portion of the first liner and the portion of the second liner into the trench.

* * * * *